US012338822B2

(12) United States Patent
Kikutake et al.

(10) Patent No.: US 12,338,822 B2
(45) Date of Patent: Jun. 24, 2025

(54) COMPRESSOR AND REFRIGERATION DEVICE

(71) Applicant: DAIKIN INDUSTRIES, LTD., Osaka (JP)

(72) Inventors: Daiki Kikutake, Osaka (JP); Tatsuya Katayama, Osaka (JP)

(73) Assignee: DAIKIN INDUSTRIES, LTD., Osaka (JP)

( * ) Notice: Subject to any disclaimer, the term of this patent is extended or adjusted under 35 U.S.C. 154(b) by 0 days.

(21) Appl. No.: 18/900,581

(22) Filed: Sep. 27, 2024

(65) Prior Publication Data

US 2025/0020124 A1 Jan. 16, 2025

Related U.S. Application Data

(63) Continuation of application No. PCT/JP2023/012205, filed on Mar. 27, 2023.

(30) Foreign Application Priority Data

Mar. 31, 2022 (JP) ..... 2022-060347

(51) Int. Cl.

| | |
|---|---|
| ***F04C 18/356*** | (2006.01) |
| ***F04C 23/02*** | (2006.01) |
| ***F04C 29/12*** | (2006.01) |
| *F04C 23/00* | (2006.01) |

(52) U.S. Cl.

CPC ..... *F04C 23/02* (2013.01); *F04C 18/3564* (2013.01); *F04C 29/12* (2013.01); (Continued)

(58) Field of Classification Search

CPC .... F04C 18/32; F04C 18/356; F04C 18/3564; F04C 18/3566; F04C 23/001; (Continued)

(56) References Cited

U.S. PATENT DOCUMENTS

2018/0291903 A1 10/2018 Higuchi
2022/0390153 A1* 12/2022 Hirayama ..... F04C 18/3564

FOREIGN PATENT DOCUMENTS

JP 2012092740 A * 5/2012
JP 2013204564 A * 10/2013
(Continued)

OTHER PUBLICATIONS

International Search Report of corresponding PCT Application No. PCT/JP2023/012205 dated May 9, 2023.
(Continued)

*Primary Examiner* — Theresa Trieu
(74) *Attorney, Agent, or Firm* — GLOBAL IP COUNSELORS, LLP

(57) ABSTRACT

A compressor is mounted on a product. The compressor includes a drive shaft having an eccentric shaft portion, an electric motor with a rotor, a compression mechanism, a balancer forming a rotary system with the drive shaft and the rotor, a casing, a suction pipe, and a discharge pipe. The compression mechanism has a piston and cylinder to form a fluid chamber, and a blade dividing the fluid chamber into low and high pressure chambers. At a connection portion of the compressor with the product, a composite vibration is a first vibration or less, the composite vibration is a synthesis of the first vibration due to torque according to a pressure difference between the low and high pressure chambers, a second vibration due to an inertial force acting on the piston by the eccentric rotational movement, and a third vibration due to a centrifugal force acting on the rotary system.

19 Claims, 12 Drawing Sheets

(52) U.S. Cl.
CPC ..... *F04C 23/008* (2013.01); *F04C 2220/00* (2013.01); *F04C 2240/80* (2013.01); *F04C 2240/807* (2013.01); *F04C 2250/301* (2013.01); *F04C 2270/12* (2013.01)

(58) Field of Classification Search
CPC ..... F04C 23/008; F04C 23/02; F04C 29/00; F04C 29/026; F04C 29/04; F04C 29/12; F04C 2220/00; F04C 2230/605; F04C 2240/80; F04C 2240/807; F04C 2250/301; F04C 2270/12; F04C 2270/125; F04C 2270/13; F04C 2270/135
See application file for complete search history.

(56) References Cited

FOREIGN PATENT DOCUMENTS

| | | |
|---|---|---|
| JP | 2014-129755 A | 7/2014 |
| JP | 2017-75589 A | 4/2017 |

OTHER PUBLICATIONS

International Preliminary Report of corresponding PCT Application No. PCT/JP2023/012205 dated Oct. 10, 2024.
European Search Report of corresponding EP Application No. 23 78 0356.4 dated May 6, 2025.

* cited by examiner

COMPRESSOR AND REFRIGERATION DEVICE

CROSS-REFERENCE TO RELATED APPLICATIONS

This is a continuation of International Application No. PCT/JP2023/012205 filed on Mar. 27, 2023, which claims priority to Japanese Patent Application No. 2022-060347, filed on Mar. 31, 2022. The entire disclosures of these applications are incorporated by reference herein.

BACKGROUND

Technical Field

The present disclosure relates to a compressor and a refrigeration apparatus.

Background Art

Japanese Unexamined Patent Publication No. 2014-129755 discloses a rotary compressor. In this rotary compressor, a balancer including an upper main weight member, a lower main weight member, an upper auxiliary weight member, and a lower auxiliary weight member is provided on a rotor of an electric motor. The center of mass of the lower main weight member, which has a greater mass than that of the upper main weight member, is located in a direction of 180°. The center of mass of the lower auxiliary weight member, which has a greater mass than that of the upper auxiliary weight member, is located in a direction of 90°. Thus, the position of the center of mass of the balancer is shifted counterclockwise from the direction of 180° by an angle θ.

SUMMARY

A first aspect of the present disclosure is directed to a compressor configured to be mounted on a product. The compressor includes a drive shaft having an eccentric shaft portion eccentric with respect to a rotation axis, an electric motor having a rotor fixed to the drive shaft and configured to rotationally drive the drive shaft, a compression mechanism, a balancer forming a rotary system together with the drive shaft and the rotor, a casing, a suction pipe provided to suck a fluid into the compression mechanism, and a discharge pipe provided to discharge a fluid compressed by the compression mechanism. The compression mechanism has a piston configured to engage with the eccentric shaft portion and make an eccentric rotational movement, a cylinder configured to house the piston and form a fluid chamber, and a blade configured to divide the fluid chamber into a low-pressure chamber and a high-pressure chamber. The casing is configured to house the drive shaft, the electric motor, the compression mechanism, and the balancer. The balancer is configured such that at a connection portion of the compressor with the product, a composite vibration being a first vibration or less, the composite vibration being a synthesis of the first vibration due to torque according to a pressure difference between the low-pressure chamber and the high-pressure chamber, a second vibration due to an inertial force acting on the piston by the eccentric rotational movement, and a third vibration due to a centrifugal force acting on the rotary system.

DETAILED DESCRIPTION OF EMBODIMENT(S)

Figure 1:
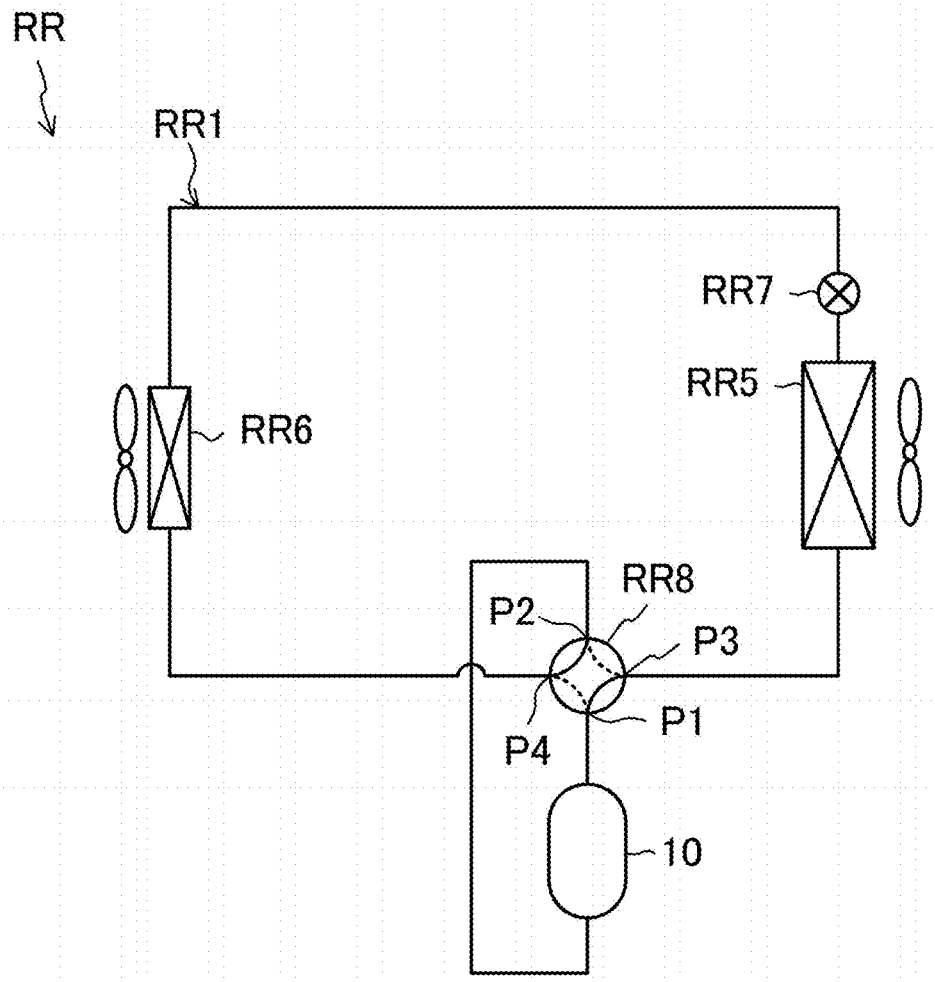
FIG. 1 is a schematic diagram illustrating, as an example, a configuration of a refrigeration apparatus of a first embodiment.

Embodiments will be described in detail below with reference to the drawings. The same reference characters denote the same or equivalent components in the drawings, and the description thereof will not be repeated.

First Embodiment

FIG. 1 is a diagram illustrating a configuration of a refrigeration apparatus (RR) of a first embodiment. The refrigeration apparatus (RR) includes a refrigerant circuit (RR1) in which refrigerant circulates. Specifically, the refrigerant circuit (RR1) has a compressor (10), a first heat exchanger (RR5), a second heat exchanger (RR6), an expansion mechanism (RR7), and a four-way switching valve (RR8). In this example, the expansion mechanism (RR7) is an electronic expansion valve. The refrigerant circuit (RR1) performs a vapor compression refrigeration cycle.

In this example, the refrigeration apparatus (RR) is an air conditioner capable of switching between a cooling operation and a heating operation. The first heat exchanger (RR5) is a heat source heat exchanger, and is installed in an outdoor space. The second heat exchanger (RR6) is a utilization heat exchanger, and is installed in an indoor space. For example, the compressor (10), the first heat exchanger (RR5), and the expansion mechanism (RR7) are provided in a casing (not illustrated) of an outdoor unit installed in the outdoor space. The second heat exchanger (RR6) is provided in a casing (not illustrated) of an indoor unit installed in the indoor space.

The compressor (10) has its discharge side connected to a first port (P1) of the four-way switching valve (RR8). The compressor (10) has its suction side connected to a second port (P2) of the four-way switching valve (RR8). The first heat exchanger (RR5) has its gas end connected to a third port (P3) of the four-way switching valve (RR8). The first heat exchanger (RR5) has its liquid end connected to the liquid end of the second heat exchanger (RR6) via the expansion mechanism (RR7). The second heat exchanger (RR6) has its gas end connected to a fourth port (P4) of the four-way switching valve (RR8).

The four-way switching valve (RR8) is switchable between a first state (indicated by solid lines in FIG. 1) and a second state (indicated by broken lines in FIG. 1). In the first state, the first port (P1) communicates with the third port (P3), and the second port (P2) communicates with the fourth port (P4). In the second state, the first port (P1) communicates with the fourth port (P4), and the second port (P2) communicates with the third port (P3).

Cooling Operation

In the cooling operation, the four-way switching valve (RR8) is in the first state, and the compressor (10) is driven. The refrigerant discharged from the compressor (10) dissipates heat in the first heat exchanger (RR5), is decompressed in the expansion mechanism (RR7), and then absorbs heat in the second heat exchanger (RR6). Thus, the indoor space is cooled. The refrigerant having flowed out of the second heat exchanger (RR6) is sucked into the compressor (10).

Heating Operation

In the heating operation, the four-way switching valve (RR8) is in the second state, and the compressor (10) is driven. The refrigerant discharged from the compressor (10) dissipates heat in the second heat exchanger (RR6), is decompressed in the expansion mechanism (RR7), and then absorbs heat in the first heat exchanger (RR5). Thus, the indoor space is heated. The refrigerant having flowed out of the first heat exchanger (RR5) is sucked into the compressor (10).

Compressor

Figure 2:
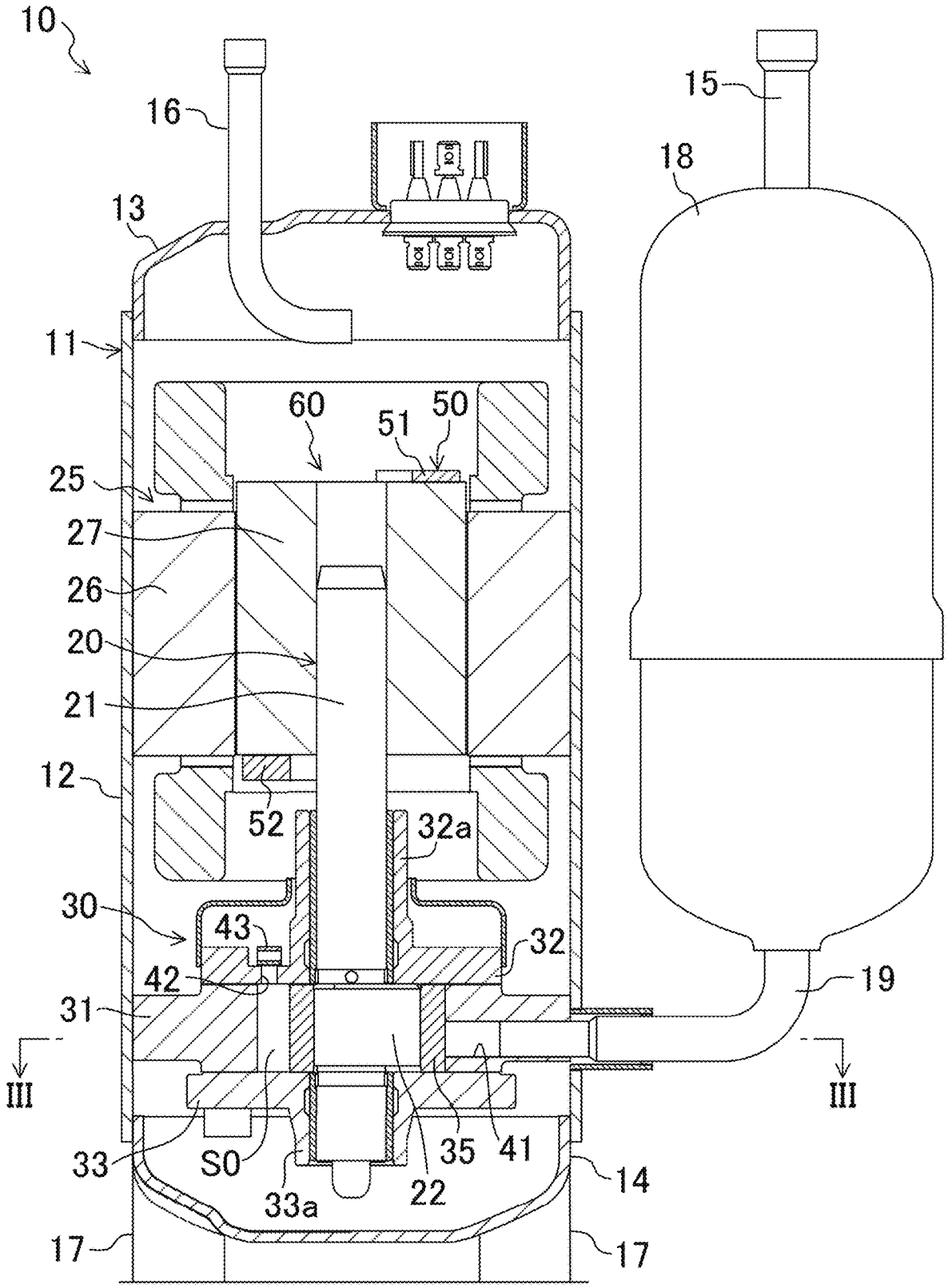
FIG. 2 is a vertical cross-section illustrating, as an example, a configuration of a compressor of the first embodiment.
Figure 3:
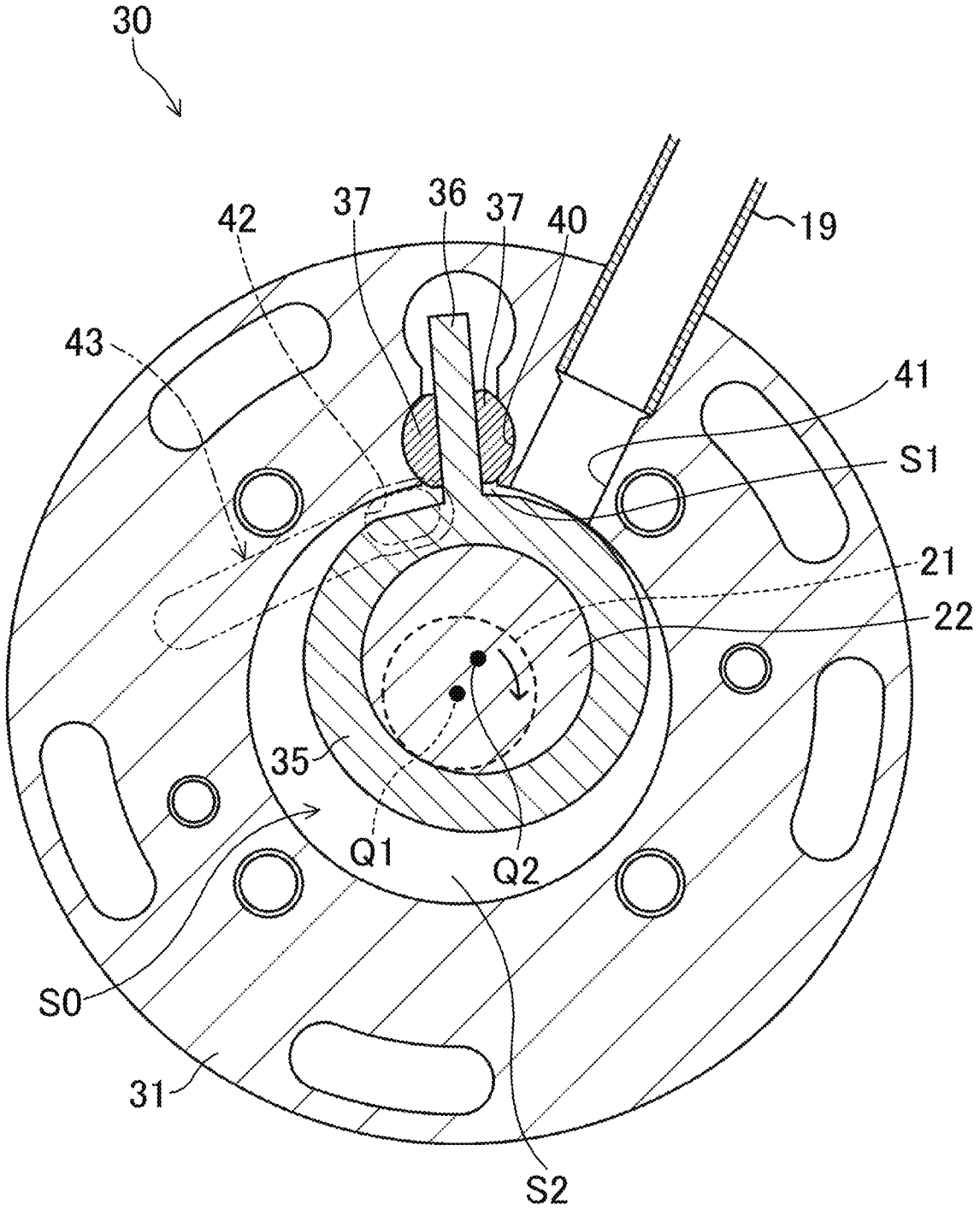
FIG. 3 is a horizontal cross-section illustrating, as an example, a configuration of a compression mechanism.

FIGS. 2 and 3 illustrate, as an example, the configuration of the compressor (10) of the first embodiment. The compressor (10) is mounted on the refrigeration apparatus (RR). FIG. 3 corresponds to a cross-sectional view taken along line III-III of FIG. 2. The compressor (10) sucks the refrigerant, compresses the sucked refrigerant, and discharges the compressed refrigerant. The refrigeration apparatus (RR) is one example of a product on which the compressor (10) is mounted. The refrigerant is one example of a fluid compressed by the compressor (10).

The compressor (10) includes a casing (11), a drive shaft (20), an electric motor (25), a compression mechanism (30), and a balancer (50).

Casing

The casing (11) houses the drive shaft (20), the electric motor (25), the compression mechanism (30), and the balancer (50). In this example, the casing (11) is a hermetically-sealed container standing upright and formed in a cylindrical shape. The casing (11) is disposed such that the cylinder axis of the casing (11) is in the up-down direction. Specifically, the casing (11) has a cylindrical barrel (12), a first end plate (13) closing an upper end portion of the barrel (12), and a second end plate (14) closing a lower end portion of the barrel (12).

In the following description, the upper side of a member corresponds to one end side of the member in the axial direction, and the lower side of the member corresponds to the other end side of the member in the axial direction. The axial direction of the member is the direction of the axis of the member. The radial direction of the member is a direction perpendicular to the axial direction of the member. The circumferential direction of the member is a direction about the axis of the member. For example, the upper side of the casing (11) corresponds to the one end side of the casing (11) in the axial direction, and the lower side of the casing (11) corresponds to the other end side of the casing (11) in the axial direction.

Suction Pipe, Discharge Pipe, and Leg

The compressor (10) further includes a suction pipe (15) and a discharge pipe (16). The casing (11) has a leg (17). The suction pipe (15) is provided for sucking the refrigerant into the compression mechanism (30). The discharge pipe (16) is provided for discharging the refrigerant compressed by the compression mechanism (30). The leg (17) is provided at a lower portion of the casing (11). The suction pipe (15), the discharge pipe (16), and the leg (17) of the casing (11) are one example of a connection portion with the product on which the compressor (10) is mounted.

In this example, the compressor (10) includes an accumulator (18) and a connection pipe (19). The accumulator (18) is a hermetically-closed container standing upright and formed in a cylindrical shape. The suction pipe (15) has its one end portion connected to the inlet of the accumulator (18). The suction pipe (15) has its other end portion connected to a component of the product on which the compressor (10) is mounted (in the example of FIG. 1, the first port (P1) of the four-way switching valve (RR8)). The connection pipe (19) is attached to a lower portion of the barrel (12) of the casing (11), and penetrates the barrel (12). The connection pipe (19) has its one end portion connected to the compression mechanism (30). The connection pipe (19) has its other end portion connected to the outlet of the accumulator (18). Thus, the suction pipe (15) is connected to the compression mechanism (30) via the accumulator (18) and the connection pipe (19).

The discharge pipe (16) is attached to the first end plate (13) of the casing (11), and penetrates the first end plate (13). The discharge pipe (16) has its one end portion communicating with the internal space of the casing (11). The discharge pipe (16) has its other end portion connected to a component of the product on which the compressor (10) is mounted (in the example of FIG. 1, the second port (P2) of the four-way switching valve (RR8)).

The leg (17) of the casing (11) is attached to the second end plate (14) of the casing (11), and supports the casing (11). The leg (17) of the casing (11) is connected to a component of the product on which the compressor (10) is mounted (for example, a bottom plate of the casing of the outdoor unit in which the compressor (10) is housed).

Drive Shaft

The drive shaft (20) extends along the cylinder axis of the casing (11). In this example, the drive shaft (20) is disposed such that the rotation axis (Q1) of the drive shaft (20) is in the up-down direction. The drive shaft (20) has a main shaft portion (21) and an eccentric shaft portion (22). The center axis of the main shaft portion (21) corresponds to the rotation axis (Q1) of the drive shaft (20). The eccentric shaft portion (22) is disposed closer to the lower end of the main shaft portion (21). The diameter of the eccentric shaft portion (22) is greater than the diameter of the main shaft portion (21). The eccentric shaft portion (22) is eccentric with respect to the rotation axis (Q1). An eccentric axis (Q2) corresponding to the center axis of the eccentric shaft portion (22) is substantially parallel with the rotation axis (Q1) of the drive shaft (20).

Electric Motor

The electric motor (25) rotationally drives the drive shaft (20). The electric motor (25) has a stator (26) and a rotor (27). In this example, the electric motor (25) is disposed above the compression mechanism (30). The stator (26) is fixed to the barrel (12) of the casing (11). The rotor (27) faces the stator (26) with a predetermined air gap therebetween. The rotor (27) is fixed to the main shaft portion (21) of the drive shaft (20). In this example, the upper side of the rotor (27) corresponds to the side of the rotor (27) distant from the compression mechanism (30). The lower side of the rotor (27) corresponds to the side of the rotor (27) closer to the compression mechanism (30).

Compression Mechanism

The compression mechanism (30) compresses the refrigerant. In this example, the compression mechanism (30) is disposed in a lower portion of the casing (11). The compression mechanism (30) has a cylinder (31), a front head (32), a rear head (33), a piston (35), a blade (36), and a pair of bushes (37). The cylinder (31), the front head (32), and the rear head (33) are fastened to each other with a bolt. The cylinder (31) is fixed to the barrel (12) of the casing (11).

The cylinder (31) houses the piston (35), and forms a fluid chamber (S0). Specifically, the cylinder (31) has a thick disk shape. A circular hole penetrating the cylinder (31) in the axial direction is formed in a center portion of the cylinder (31). The piston (35) is housed in the hole of the cylinder (31).

The front head (32) is a plate-shaped member closing the upper end of the cylinder (31). A main bearing portion (32*a*) for supporting the drive shaft (20) is provided at a center portion of the front head (32). The main bearing portion (32*a*) is in a cylindrical shape, and protrudes upward from the front head (32). A portion of the main shaft portion (21) of the drive shaft (20) above the eccentric shaft portion (22) is inserted into the main bearing portion (32*a*).

The rear head (33) is a plate-shaped member closing the lower end of the cylinder (31). An auxiliary bearing portion (33*a*) for supporting the drive shaft (20) is provided at a center portion of the rear head (33). The auxiliary bearing portion (33*a*) is in a cylindrical shape, and protrudes downward from the rear head (33). A portion of the main shaft portion (21) of the drive shaft (20) below the eccentric shaft portion (22) is inserted into the auxiliary bearing portion (33*a*).

The piston (35) engages with the eccentric shaft portion (22) of the drive shaft (20) and makes an eccentric rotational movement. Specifically, the piston (35) is formed in a cylindrical shape. The eccentric shaft portion (22) of the drive shaft (20) is rotatably fitted in the piston (35). The piston (35) is housed in the hole of the cylinder (31) with the eccentric shaft portion (22) of the drive shaft (20) fitted in the piston (35). The outer peripheral surface of the piston (35) is in sliding contact with the inner peripheral surface of the cylinder (31). Since the piston (35) is housed in the cylinder (31), the fluid chamber (S0) is formed between the inner peripheral surface of the cylinder (31) and the outer peripheral surface of the piston (35).

The blade (36) divides the fluid chamber (S0) formed between the cylinder (31) and the piston (35) into a low-pressure chamber (S1) and a high-pressure chamber (S2). In this example, the blade (36) is formed in a flat plate shape, and protrudes outward in the radial direction of the piston (35) from the outer peripheral surface of the piston (35). The blade (36) is formed integrally with the piston (35).

A bush hole (40) is formed in the cylinder (31). The bush hole (40) penetrates the cylinder (31) in the axial direction. While having the blade (36) interposed between the pair of bushes (37) so as to be movable back and forth, the pair of bushes (37) is fitted swingably in the bush hole (40) formed in the cylinder (31). The blade (36) is swingably supported by the pair of bushes (37).

The cylinder (31) has a suction port (41). The suction port (41) penetrates the cylinder (31) in the radial direction. One end of the suction port (41) opens in the inner peripheral surface of the cylinder (31). The open end of the suction port (41) is located on one end side of the bush hole (40) in the circumferential direction of the cylinder (31) (on a forward position in the rotation direction of the drive shaft (20)), and is adjacent to the bush hole (40). The suction port (41) communicates with the low-pressure chamber (S1) of the fluid chamber (S0). One end portion of the connection pipe (19) is inserted in the other end of the suction port (41).

The front head (32) has a discharge port (42). The discharge port (42) penetrates the front head (32) in the thickness direction (the axial direction of the drive shaft (20)). One end of the discharge port (42) is open in the lower surface of the front head (32). The open end of the discharge port (42) is located on the other end side of the bush hole (40) in the circumferential direction of the cylinder (31) (on a backward position in the rotation direction of the drive shaft (20)). The discharge port (42) communicates with the high-pressure chamber (S2) of the fluid chamber (S0). A discharge valve (43) for opening and closing the discharge port (42) is provided at the other end of the discharge port (42). For example, the discharge valve (43) is a reed valve.

Balancer

The balancer (50), together with the drive shaft (20) and the rotor (27) of the electric motor (25), forms a rotary system (60). In this example, the balancer (50) has a first weight (51) and a second weight (52).

The first weight (51) is disposed on the side of the rotor (27) distant from the compression mechanism (30) (on the upper side in the example of FIG. 2). The second weight (52) is disposed on the side of the rotor (27) close to the compression mechanism (30) (on the lower side in the example of FIG. 2). Specifically, the first weight (51) is fixed to the upper end surface of the rotor (27), and the second weight (52) is fixed to the lower end surface of the rotor (27). For example, the first weight (51) and the second weight (52) are made of metal such as brass.

Operation of Compressor

Next, the operation of the compressor (10) will be described.

When the electric motor (25) is energized, the drive shaft (20) rotates in a forward rotation direction (clockwise direction in the example of FIG. 3). When the drive shaft (20) rotates, the piston (35) that is formed integrally with the blade (36) makes an eccentric rotational movement while swinging.

When the drive shaft (20) rotates and the piston (35) moves accordingly, the volume of the low-pressure chamber (S1) gradually increases, and the low-pressure gas refrigerant is sucked into the low-pressure chamber (S1) through the suction port (41). At the same time, the volume of the high-pressure chamber (S2) gradually decreases, and the gas refrigerant in the high-pressure chamber (S2) is compressed.

When the pressure of the gas refrigerant in the high-pressure chamber (S2) exceeds the pressure of the gas refrigerant in the internal space of the casing (11), the discharge valve (43) is opened, and the gas refrigerant in the high-pressure chamber (S2) is discharged to the internal space of the casing (11) through the discharge port (42). The high-pressure gas refrigerant discharged from the compression mechanism (30) to the internal space of the casing (11) flows out of the casing (11) through the discharge pipe (16).

Vibration Due to Compression Torque

Torque corresponding to a difference between the low-pressure chamber (S1) and the high-pressure chamber (S2) acts on the rotary system (60). In the following description, the torque corresponding to the difference between the low-pressure chamber (S1) and the high-pressure chamber (S2) will be referred to as "compression torque," and vibration due to the compression torque will be referred to as "first vibration ($a_1$)." Further, in the following description, the amplitude of the first vibration ($a_1$) will be referred to as "$A_1$," and the phase of the first vibration ($a_1$) will be referred to as "$\Phi_1$." The compression torque acts substantially in a direction from the high-pressure chamber (S2) to the low-pressure chamber (S1). The waveform of the first vibration ($a_1$) is expressed by the following expression.

$$a_1 = A_1 e^{i(\theta+\Phi_1)} \quad \text{Mathematical Expression 7}$$

Vibration Due to Piston Inertial Force

An inertial force due to the eccentric rotational movement acts on the piston (35) making the eccentric rotational movement. In the following description, the inertial force acting on the piston (35) due to the eccentric rotational movement will be referred to as a "piston inertial force," and vibration due to the piston inertial force will be referred to as "second vibration ($a_2$)." Further, in the following description, the amplitude of the second vibration ($a_2$) will be referred to as "$A_2$," and the phase of the second vibration ($a_2$) will be referred to as "$\Phi_2$." The waveform of the second vibration ($a_2$) is expressed by the following expression.

$$a_2 = A_2 e^{i(\theta+\Phi_2)} \quad \text{Mathematical Expression 8}$$

Vibration Due to Rotary System Centrifugal Force

A centrifugal force acts on the rotary system (60). In the following description, the centrifugal force acting on the rotary system (60) will be referred to as "rotary system centrifugal force," and vibration due to the rotary system centrifugal force will be referred to as "third vibration ($a_3$)." Further, in the following description, the amplitude of the third vibration ($a_3$) will be referred to as "$A_3$," and the phase of the third vibration ($a_3$) will be referred to as "$\Phi_3$." The rotary system centrifugal force includes a centrifugal force acting on the eccentric shaft portion (22), a centrifugal force acting on the rotor (27), a centrifugal force acting on the first weight (51), and a centrifugal force acting on the second weight (52). The waveform of the third vibration ($a_3$) is expressed by the following expression.

$$a_3 = A_3 e^{i(\theta+\Phi_3)} \quad \text{Mathematical Expression 9}$$

Composite Vibration

The "compression torque," the "piston inertial force," and the "rotary system centrifugal force" described above act on the compressor (10) as an excitation force. In the following description, the synthesis of the first vibration ($a_1$), the second vibration ($a_2$), and the third vibration ($a_3$) will be referred to as "composite vibration ($a_t$)." The waveform of the composite vibration ($a_t$) and the magnitude $|a_t|$ of the composite vibration ($a_t$) are expressed by the following expression.

$$a_t = \left(A_1 e^{i\Phi_1} + A_2 e^{i\Phi_2} + A_3 e^{i\Phi_3}\right) e^{i\theta} \quad \text{Mathematical Expression 10}$$

$$|a_t| = \left|A_1 e^{i\Phi_1} + A_2 e^{i\Phi_2} + A_3 e^{i\Phi_3}\right|$$

Various Parameters of Compressor

In the following description, the weight of the first weight (51) is denoted by $m_1$ [g], the weight of the second weight (52) is denoted by $m_2$ [g], the weight of the eccentric shaft portion (22) is denoted by $m_e$ [g], and the weight of the piston (35) is denoted by $m_P$ [g].

Figure 4:
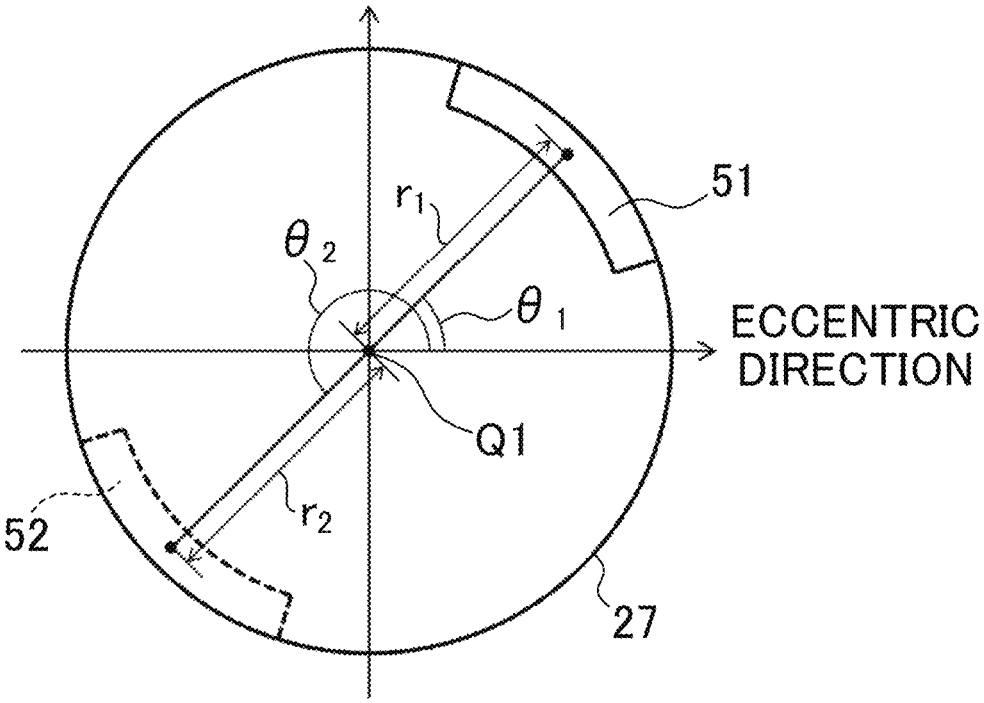
FIG. 4 is a schematic diagram illustrating, as an example, the distances and angles of a first weight and a second weight.

Moreover, in the following description, as illustrated in FIG. 4, a distance between the first weight (51) and the rotation axis (Q1) is denoted by $r_1$ [mm], and a distance between the second weight (52) and the rotation axis (Q1) is denoted by $r_2$ [mm]. Specifically, the distance between the first weight (51) and the rotation axis (Q1) is a radial distance between the mass point of the first weight (51) and the rotation axis (Q1). The distance between the second weight (52) and the rotation axis (Q1) is a radial distance between the mass point of the second weight (52) and the rotation axis (Q1).

In the following description, as illustrated in FIG. 4, the angle of the first weight (51) about the rotation axis (Q1) with respect to the eccentric direction of the eccentric shaft portion (22) is denoted by $\theta_1$ [deg], and the angle of the second weight (52) about the rotation axis (Q1) with respect to the eccentric direction of the eccentric shaft portion (22) is denoted by $\theta_2$ [deg]. Specifically, the angle of the first weight (51) about the rotation axis (Q1) is an angle from a "reference straight line extending in the radial direction from the rotation axis (Q1) to the eccentric axis (Q2)" to a "first straight line extending in the radial direction from the rotation axis (Q1) to the mass point of the first weight (51)." The angle of the second weight (52) about the rotation axis (Q1) is an angle from the "reference straight line" to a "second straight line extending in the radial direction from the rotation axis (Q1) to the mass point of the second weight (52)."

Figure 5:
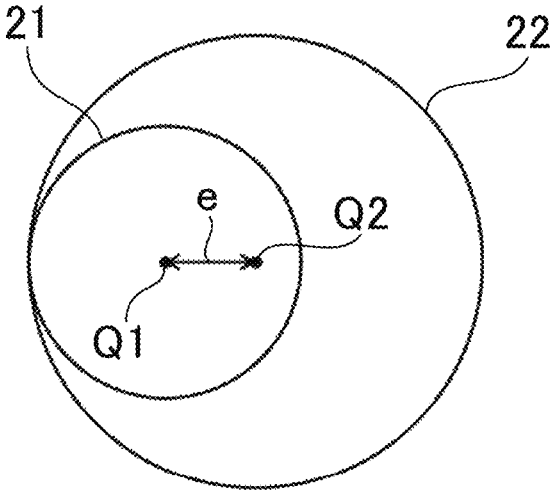
FIG. 5 is a schematic diagram illustrating, as an example, the eccentricity of an eccentric shaft portion.

In the following description, the eccentricity of the eccentric shaft portion (22) is e [mm], as illustrated in FIG. 5. Specifically, the eccentricity of the eccentric shaft portion (22) is a radial distance between the rotation axis (Q1) and the eccentric axis (Q2).

Figure 6:
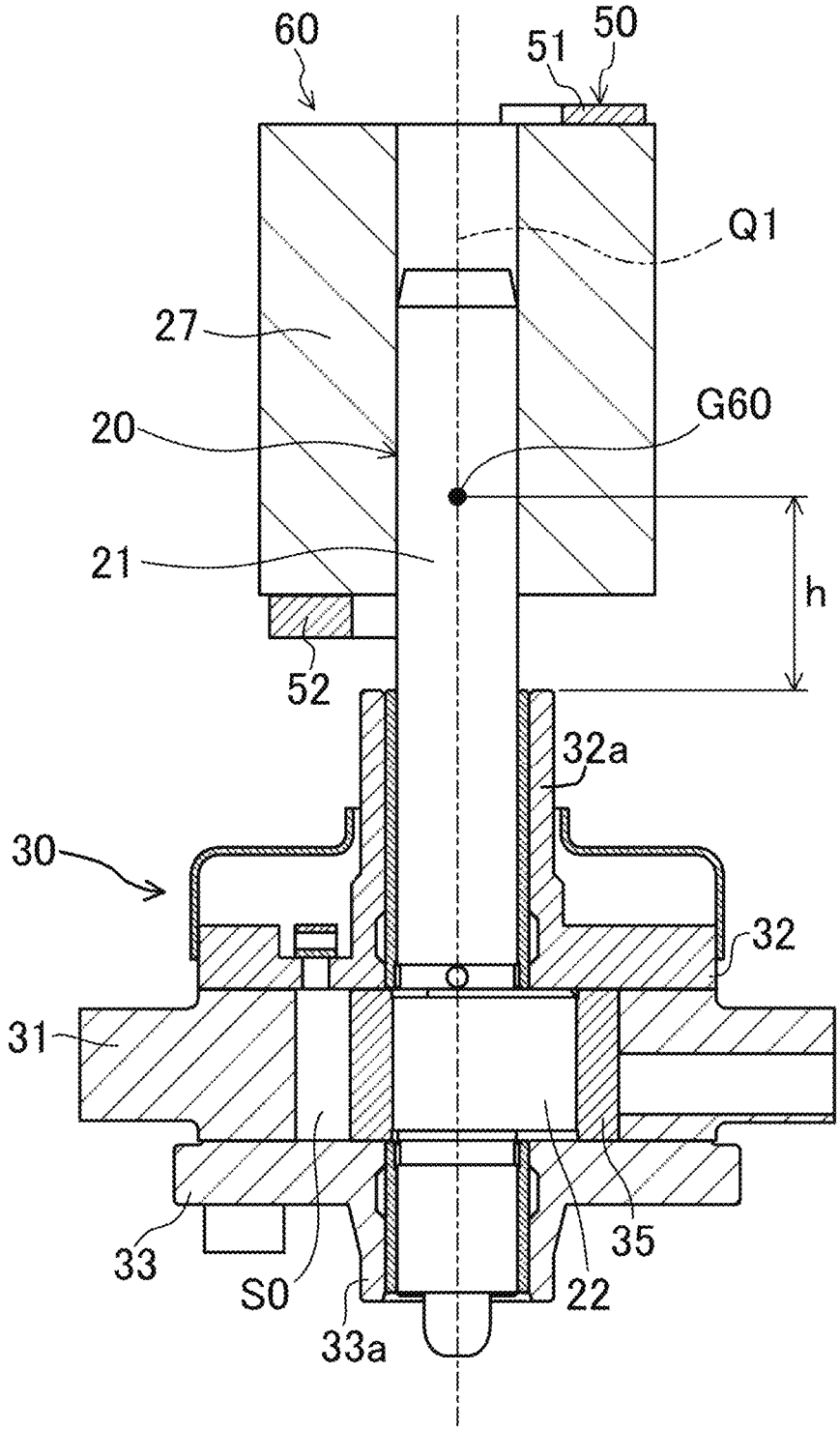
FIG. 6 is a vertical cross-section illustrating, as an example, a distance between the compression mechanism and the center of gravity of a rotary system.

Further, in the following description, as illustrated in FIG. 6, a distance between the compression mechanism (30) and the center of gravity (G60) of the rotary system (60) is denoted by h [mm]. Specifically, the distance between the compression mechanism (30) and the center of gravity (G60) of the rotary system (60) is an axial distance from the distal end of the main bearing portion (32*a*) of the front head (32) to the center of gravity (G60) of the rotary system (60).

Angle Difference Between First Weight and Second Weight, Static Balance Amount, and Dynamic Balance Amount An angle difference (X) between the first weight (51) and the second weight (52) is expressed by Expression A below. The static balance amount (Y) of the compressor (10) is expressed by Expression B below. The dynamic balance amount (Z) of the compressor (10) is expressed by Expression C below.

Mathematical Expression 11

$$X = \theta_2 - \theta_1 \cdots (A)$$

$$Y = m_1 r_1 \cos\theta_1 + m_2 r_2 \cos\theta_2 + (m_e + m_p)e \cdots (B)$$

$$Z = Y \cdot h \cdots (C)$$

Features of First Embodiment

In the first embodiment, the balancer (50) is configured such that the composite vibration ($a_t$) is the first vibration ($a_1$) or less at the connection portion of the compressor (10) with the product. For example, for each of the first weight (51) and the second weight (52) of the balancer (50), the "weight," the "distance to the rotation axis (Q1)," and the "angle about the rotation axis (Q1) with respect to the eccentric direction of the eccentric shaft portion (22)" are adjusted such that the composite vibration ($a_t$) is the first vibration ($a_1$) or less at the connection portion of the compressor (10) with the product.

Specifically, in the first embodiment, the balancer (50) is configured to satisfy the following Expression 1 at the connection portion of the compressor (10) with the product when the operation condition of the compressor (10) is a "cooling operation condition where a pressure difference between the refrigerant sucked through the suction pipe (15) and the refrigerant discharged through the discharge pipe (16) is 2.0 MPa."

Mathematical Expression 12

$$A_2^2+A_3^2+2A_1A_2\cos(\Phi_1-\Phi_2)+2A_2A_3\cos(\Phi_2-\Phi_3)+2A_3A_1\cos(\Phi_3-\Phi_1)\leq 0 \quad (1)$$

More specifically, in the first embodiment, the connection portion, i.e., a target for vibration reduction, of the compressor (10) with the product is the discharge pipe (16). The balancer (50) is configured to satisfy Expressions 11 to 17 below at the discharge pipe (16) when the operation condition of the compressor (10) is the above-described cooling operation condition.

Mathematical Expression 13

$$Y \leq 18.8X - 3215 \cdots (11)$$

$$Z \leq 179X - 30480 \cdots (12)$$

$$Z \leq 9Y + 480 \cdots (13)$$

$$Z \geq 9Y - 290 \cdots (14)$$

$$X \leq 179.5 \cdots (15)$$

$$Y \geq 0 \cdots (16)$$

$$Z \geq 0 \cdots (17)$$

Description of Comparative Example

Here, before description of results of study by the inventors of the present application, a compressor of a comparative example will be described. For convenience of explanation, among the components of the compressor of the comparative example, components similar to those of the compressor (10) of the first embodiment will be described using the reference numerals similar to those of the components of the compressor (10) of the first embodiment.

Description of First Comparative Example

First, a compressor of a first comparative example will be described. The compressor of the first comparative example is different from the compressor (10) of the first embodiment in the configuration of the balancer (50). Other configurations of the compressor of the first comparative example are similar to those of the compressor (10) of the first embodiment. In the first comparative example, the angle difference (X) between the first weight (51) and the second weight (52) is set to be 180°.

Figure 7:
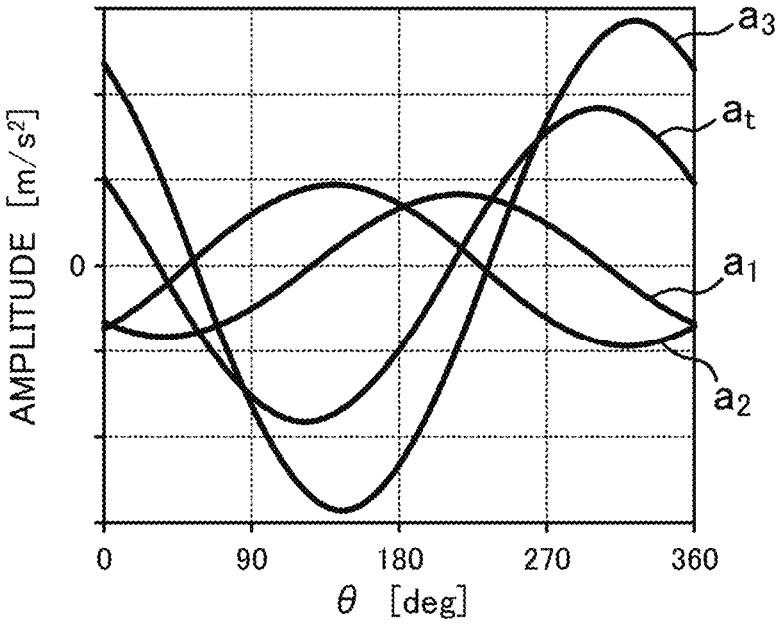
FIG. 7 is a graph showing, as an example, a relationship between various types of vibration and phases in a compressor of a first comparative example.

In the compressor of the first comparative example, the waveforms of the first vibration ($a_1$), the second vibration ($a_2$), the third vibration ($a_3$), and the composite vibration ($a_t$) are as shown in FIG. 7. Waveforms indicating the magnitudes (magnitudes for each number of rotations) of the first vibration ($a_1$), the second vibration ($a_2$), the third vibration ($a_3$), and the composite vibration ($a_t$) are as shown in FIG. 8.

Figure 8:
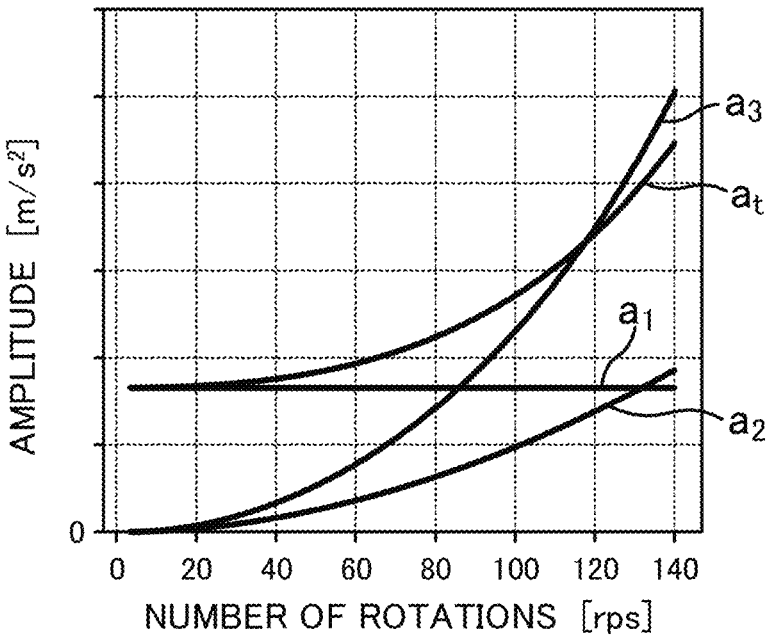
FIG. 8 is a graph showing, as an example, a relationship between various types of vibration and numbers of rotations in the compressor of the first comparative example.

As illustrated in FIG. 8, in the compressor of the first comparative example, the composite vibration ($a_t$) is the first vibration ($a_1$) or more in the entire range of the number of rotations at which the compressor is operable. In the example of FIG. 8, the range of the number of rotations at which the compressor is operable is a range from zero to 140 rps.

Description of Second Comparative Example

Next, a compressor of a second comparative example will be described. The compressor of the second comparative example corresponds to a compressor disclosed in Patent Document 1 (Japanese Unexamined Patent Publication No. 2014-129755). The compressor of the second comparative example is different from the compressor (10) of the first embodiment in the configuration of the balancer (50). Other configurations of the compressor of the second comparative example are similar to those of the compressor (10) of the first embodiment. In the second comparative example, the position of the center of mass of the balancer (50) is shifted counterclockwise from the direction of 180° by a predetermined angle. In the compressor of the second comparative example, only the phase of the rotary system centrifugal force is taken into consideration.

Figure 9:
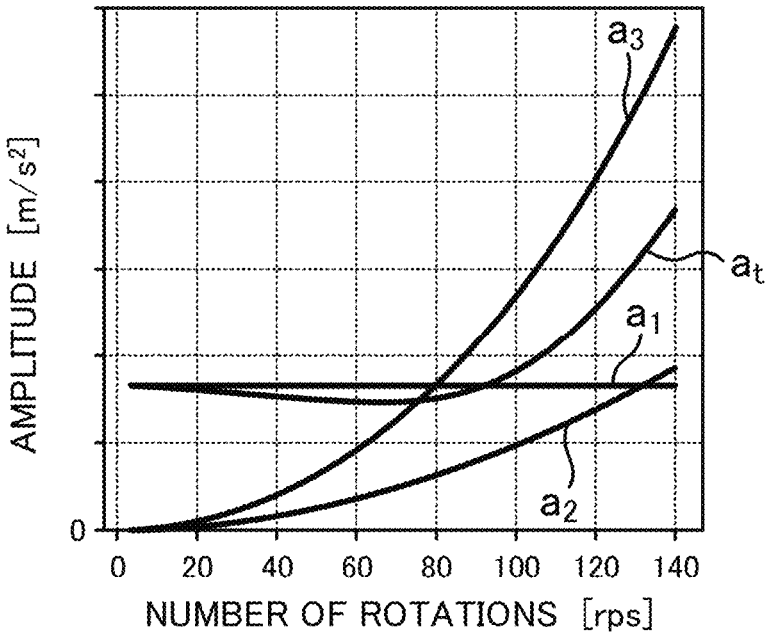
FIG. 9 is a graph showing, as an example, a relationship between various types of vibration and numbers of rotations in a compressor of a second comparative example.

In the compressor of the second comparative example, waveforms indicating the magnitudes (magnitudes for each number of rotations) of the first vibration ($a_1$), the second vibration ($a_2$), the third vibration ($a_3$), and the composite vibration ($a_t$) are as shown in FIG. 9.

As illustrated in FIG. 9, in the compressor of the second comparative example, the composite vibration ($a_t$) is the first vibration ($a_1$) or more in a high-speed range within the range of the number of rotations at which the compressor is operable. In the example of FIG. 9, the range of the number of rotations at which the compressor is operable is a range from zero to 140 rps, and the high-speed range is a range from 90 rps to 140 rps.

Results of Study by Inventors of the Present Application

The inventors of the present application have found, as a result of the study, that among vibrations of the compressor (10), "a vibration of a primary component which is N times (N is an integer) the number of rotations of the compressor (10)" is relatively greater than the vibrations of other frequency components, that the excitation forces which are main causes of the vibration of the primary component are the following three forces, i.e., the "compression torque," the "piston inertial force," and the "rotary system centrifugal force," and that the vibration of the primary component is caused by superposition of these excitation forces. Moreover, the inventors of the present application have found that the piston inertial force and the rotary system centrifugal force vary in proportion to the square of the number of rotations of the compressor (10), and therefore that as the number of rotations of the compressor (10) increases, the vibration of the primary component tends to increase sharply in accordance with the increase in the number of rotations of the compressor (10).

Based on the above-described findings, the inventors of the present application have found that the vibration at the connection portion of the compressor (10) with the product can be properly reduced by taking into account the composite vibration ($a_t$) which is the synthesis of the first vibration ($a_1$) due to the compression torque, the second vibration ($a_2$) due to the piston inertial force, and the third vibration ($a_3$) due to the rotary system centrifugal force.

Specifically, the inventors of the present application have found that the vibration (particularly, the vibration in the high-speed range) at the connection portion of the compressor (10) with the product can be reduced by setting the magnitude of the composite vibration ($a_t$) at the connection portion of the compressor (10) with the product to the magnitude of the first vibration ($a_1$) or less.

Here, a relational expression enabling a reduction in the vibration (particularly, the vibration in the high-speed range) at the connection portion of the compressor (10) with the product is expressed by Expression 5 below, where the magnitude of the composite vibration ($a_t$) is "$|a_t|$" and the magnitude of the first vibration ($a_1$) is "$|a_1|$."

$$|a_t| \le |a_1| \cdots (5)$$

Mathematical Expression 14

Expression 5 above can be expanded as Expression 6 below.

$$|a_t|^2 \le |a_1|^2$$

Mathematical Expression 15

$$\left|A_1 e^{i\Phi_1} + A_2 e^{i\Phi_2} + A_3 e^{i\Phi_3}\right|^2 \le A_1^2$$

$$A_1^2 + A_2^2 + A_3^2 + 2A_1A_2\cos(\Phi_1 - \Phi_2) + 2A_2A_3\cos(\Phi_2 - \Phi_3) + 2A_3A_1\cos(\Phi_3 - \Phi_1) \le A_1^2 \cdots (6)$$

Expression 6 above is expanded, and Expression 1 is obtained.

$$A_2^2 + A_3^2 + 2A_1A_2\cos(\Phi_1 - \Phi_2) + 2A_2A_3\cos(\Phi_2 - \Phi_3) + 2A_3A_1\cos(\Phi_3 - \Phi_1) \le 0 \cdots (1)$$

Mathematical Expression 16

Figure 10:
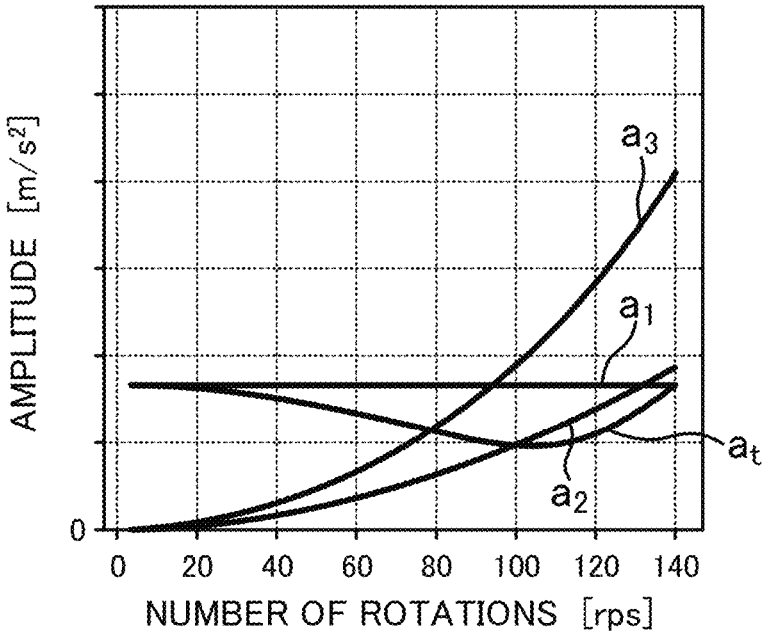
FIG. 10 is a graph showing, as an example, a relationship between various types of vibration and numbers of rotations in the compressor of a first embodiment.

In the compressor (10) having the balancer (50) configured to satisfy Expression 1 above, the waveforms indicating the magnitudes (magnitudes for each number of rotations) of the first vibration ($a_1$), the second vibration ($a_2$), the third vibration ($a_3$), and the composite vibration ($a_t$) are as shown in FIG. 10.

As illustrated in FIG. 10, in the compressor (10) having the balancer (50) configured to satisfy Expression 1 above, the composite vibration ($a_t$) is the first vibration ($a_1$) or less in the entire range of the number of rotations at which the compressor is operable. Particularly, the composite vibration ($a_t$) is less than the first vibration ($a_1$) in the high-speed range within the range of the number of rotations at which the compressor is operable. In the example of FIG. 10, the range of the number of rotations at which the compressor is operable is a range from zero to 140 rps, and the high-speed range is a range from 90 rps to 140 rps.

The vibration at the connection portion of the compressor (10) with the product varies depending on the operation condition of the compressor (10). Thus, the inventors of the present application set the operation condition for evaluation of the vibration at the connection portion of the compressor (10) with the product to be the "cooling operation condition where a pressure difference between the refrigerant sucked through the suction pipe (15) and the refrigerant discharged through the discharge pipe (16) is 2.0 MPa." This cooling operation condition can be taken as a typical cooling operation condition.

As described above, the inventors of the present application have found that the balancer (50) configured to satisfy the above Expression 1 when the operation condition of the compressor (10) is the "cooling operation condition where a pressure difference between the refrigerant sucked through the suction pipe (15) and the refrigerant discharged through the discharge pipe (16) is 2.0 MPa" made it possible to reduce the vibration at the connection portion of the compressor (10) with the product when the operation condition of the compressor (10) is the above cooling operation condition (typical cooling operation condition).

Results of Further Study by Inventors of the Present Application

As a result of further study, the inventors of the present application have found the relational expressions (Expressions 11 to 17 above) which allow the balancer (50) to be easily configured to satisfy the above Expression 1 at the discharge pipe (16) when the connection portion, i.e., a target for vibration reduction, of the compressor (10) with the product is the "discharge pipe (16)" and the operation condition of the compressor (10) is the "cooling operation condition where a pressure difference between the refrigerant sucked through the suction pipe (15) and the refrigerant discharged through the discharge pipe (16) is 2.0 MPa." Specifically, the above-described relational expressions have been found by the following procedure.

First, the inventors of the present application attempted to express a necessary condition for satisfying the above Expression 1 when the connection portion, i.e., a target for vibration reduction, of the compressor (10) with the product is the discharge pipe (16) and the operation condition of the compressor (10) is the above-described cooling operation condition, by using the "angle difference (X) between the first weight (51) and the second weight (52)," the "static balance amount (Y)," and the "dynamic balance amount (Z)."

To make that attempt, the inventors of the present application performed a simulation in a target compressor (10) to obtain "amplitude and phase of the first vibration ($a_1$)," "amplitude and phase of the second vibration ($a_2$)," and "amplitude and phase of the third vibration ($a_3$)" under the above-described conditions (i.e., when the connection portion, i.e., a target for vibration reduction, of the compressor (10) with the product is the discharge pipe (16), and the operation condition of the compressor (10) is the above-described cooling operation condition).

Next, the inventors of the present application derived an index value shown on the left side of Expression 1 above, based on the "amplitude and phase of the first vibration ($a_1$)," the "amplitude and phase of the second vibration ($a_2$)," and the "amplitude and phase of the third vibration ($a_3$)."

Figure 11:
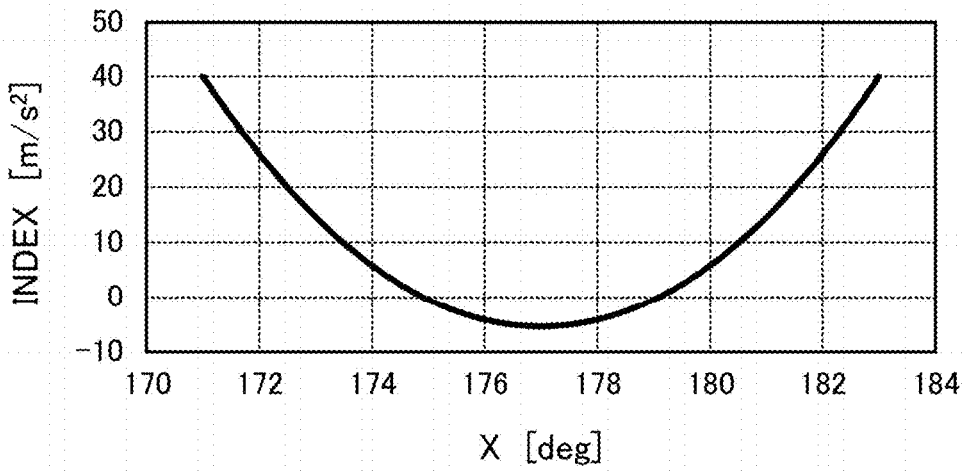
FIG. 11 is a graph showing, as an example, a relationship between an index value related to composite vibration at a connection portion of a compressor with a product and an angle difference (X) between the first weight and the second weight.

The inventors of the present application checked the dependency of the index value on the "angle difference (X) between the first weight (51) and the second weight (52)." Specifically, the inventors of the present application changed the "angle difference (X) between the first weight (51) and the second weight (52)" of the target compressor (10) and performed the above simulation for each "angle difference (X) between the first weight (51) and the second weight (52)," thereby obtaining the index value for each "angle difference (X) between the first weight (51) and the second weight (52)." As shown in FIG. 11, the "index value" and the "angle difference (X) between the first weight (51) and the second weight (52)" were expressed by a quadratic function convex downward.

Figure 12:
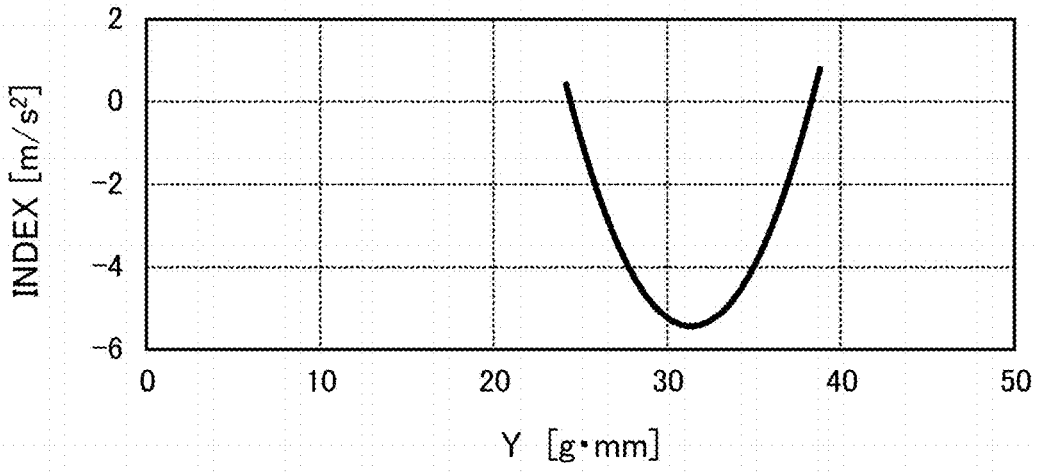
FIG. 12 is a graph showing, as an example, a relationship between the index value related to the composite vibration at the connection portion of the compressor with the product and the static balance amount (Y) of the compressor.

The inventors of the present application also checked the dependency of the index value on the "static balance amount (Y)." Specifically, the inventors of the present application changed the "static balance amount (Y)" of the target compressor (10) and performed the above-described simulation for each "static balance amount (Y)," thereby obtaining the index value for each "static balance amount (Y)." As shown in FIG. 12, a relationship between the "index value" and the "static balance amount (Y)" was expressed by a quadratic function convex downward.

Figure 13:
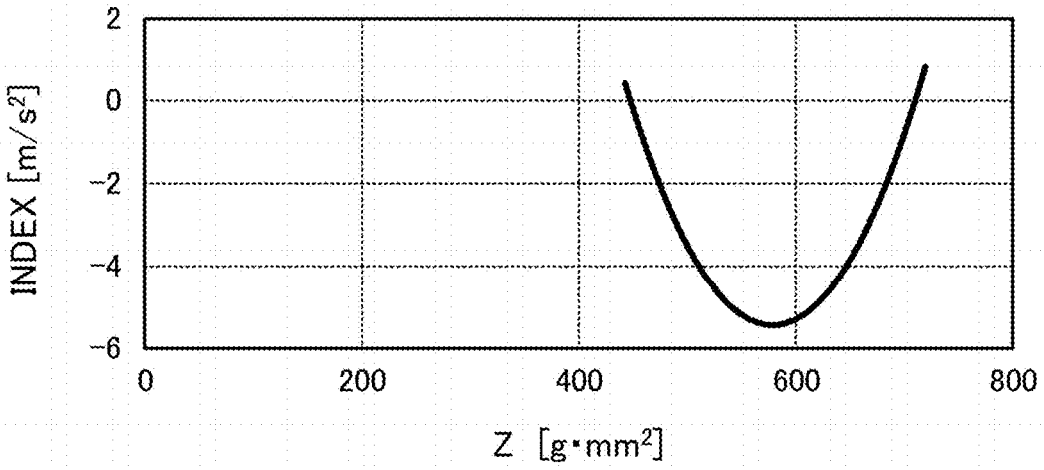
FIG. 13 is a graph showing, as an example, a relationship between the index value related to the composite vibration at the connection portion of the compressor with the product and the dynamic balance amount (Z) of the compressor.

The inventors of the present application also checked the dependency of the index value on the "dynamic balance amount (Z)." Specifically, the inventors of the present application changed the "dynamic balance amount (Z)" of the target compressor (10) and performed the above-described simulation for each "dynamic balance amount (Z)," thereby obtaining the index value for each "dynamic balance amount (Z)." As shown in FIG. 13, a relationship between the "index value" and the "dynamic balance amount (Z)" was expressed by a quadratic function convex downward.

Figure 14:
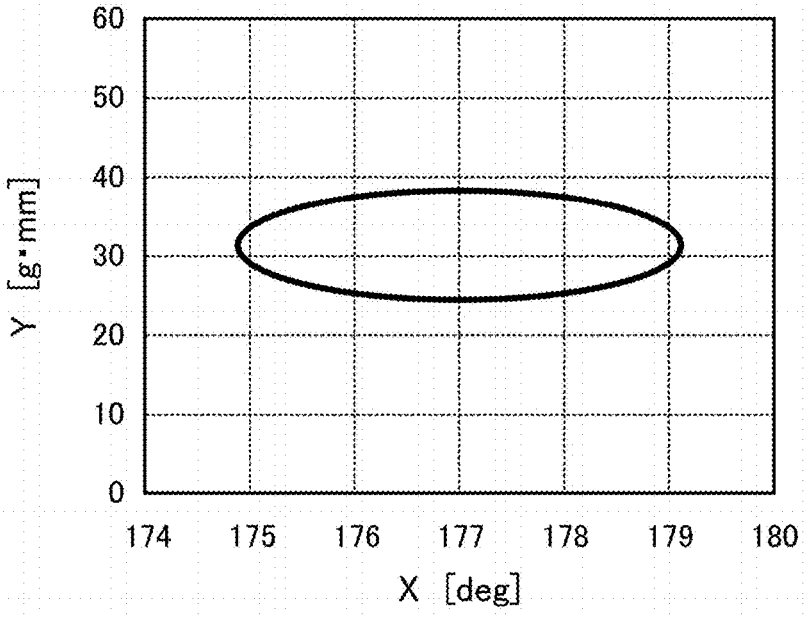
FIG. 14 is a graph showing, as an example, a relationship between an angle difference (X) between the first weight and the second weight and the static balance amount (Y) of the compressor when the index value related to the composite vibration at the connection portion of the compressor with the product is zero or less.

Next, the inventors of the present application checked a relationship between the "angle difference (X) between the first weight (51) and the second weight (52)" and the "static balance amount (Y)" when the index value was zero or less (in other words, when Expression 1 above was satisfied). If a region in which the index value is zero or less is shown on a graph whose horizontal axis represents the "angle difference (X) between the first weight (51) and the second weight (52)" and vertical axis represents the "static balance amount (Y)," the region in which the index value is zero or less is an ellipse as shown in FIG. 14. In other words, the combination of the "angle difference (X) between the first weight (51) and the second weight (52)" and the "static balance amount (Y)" present in the elliptical region shown in FIG. 14 is a combination in which the index value is zero or less.

The inventors of the present application also checked a relationship between the "angle difference (X) between the first weight (51) and the second weight (52)" and the "dynamic balance amount (Z)" when the index value was zero or less. If a region in which the index value is zero or less is shown on a graph whose horizontal axis represents the "angle difference (X) between the first weight (51) and the second weight (52)" and vertical axis represents the "dynamic balance amount (Z)," the region in which the index value is zero or less is an ellipse similar to that in the example of FIG. 14.

The inventors of the present application also checked a relationship between the "static balance amount (Y)" and the "dynamic balance amount (Z)" when the index value was zero or less. If a region in which the index value is zero or less is shown on a graph whose horizontal axis represents the "static balance amount (Y)" and vertical axis represents the "dynamic balance amount (Z)," the region in which the index value is zero or less is an ellipse similar to that in the example of FIG. 14.

Next, the inventors of the present application performed a simulation in each of a plurality of compressors (10) different from each other in details of the components to obtain, for each of the plurality of compressors (10), "amplitude and phase of the first vibration ($a_1$)," "amplitude and phase of the second vibration ($a_2$)," and "amplitude and phase of the third vibration ($a_3$)" under the above-described conditions (i.e., when the connection portion, i.e., a target for vibration reduction, of the compressor (10) with the product is the discharge pipe (16), and the operation condition of the compressor (10) is the above-described cooling operation condition).

Each of the plurality of compressors (10) is a typical existing compressor having a configuration similar to the configuration shown in FIGS. 2 and 3, and the plurality of compressors (10) differ from each other in at least one of a size or a position of a component.

Figure 15:
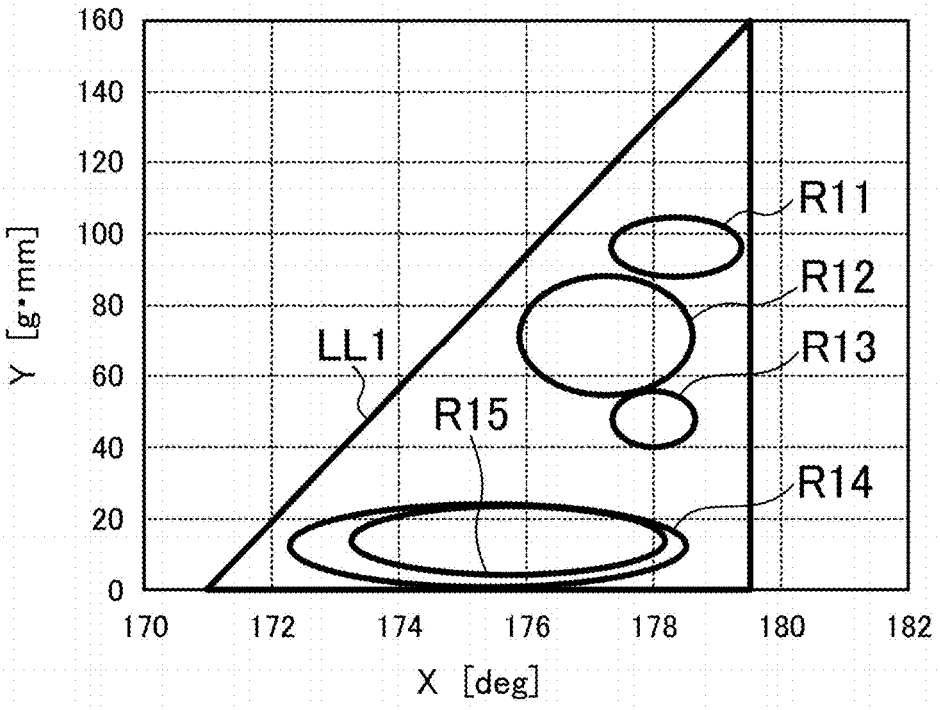
FIG. 15 is a graph showing, as an example, a first boundary related to the relationship between the angle difference (X) between the first weight and the second weight and the static balance amount (Y) of the compressor when the index value related to the composite vibration at the connection portion of the compressor with the product is zero or less.

Next, the inventors of the present application checked, for each of the plurality of compressors (10), a relationship between the "angle difference (X) between the first weight (51) and the second weight (52)" and the "static balance amount (Y)" when the index value was zero or less. As shown in FIG. 15, a plurality of regions corresponding to the plurality of compressors (10) were depicted on a graph whose horizontal axis represents the "angle difference (X) between the first weight (51) and the second weight (52)" and vertical axis represents the "static balance amount (Y)." In the example of FIG. 15, five regions (R11 to R15) corresponding to five typical compressors (first to fifth compressors) are shown. The region (R11) corresponds to the first compressor. The regions (R12 to R15) correspond to the second to fifth compressors.

The inventors of the present application determined a first boundary (LL1) which defines an inclusion region including the plurality of regions in the graph of FIG. 15. In the example of FIG. 15, the first boundary (LL1) is formed by three straight lines which define a triangular region including the five regions (R11 to R15).

Figure 16:
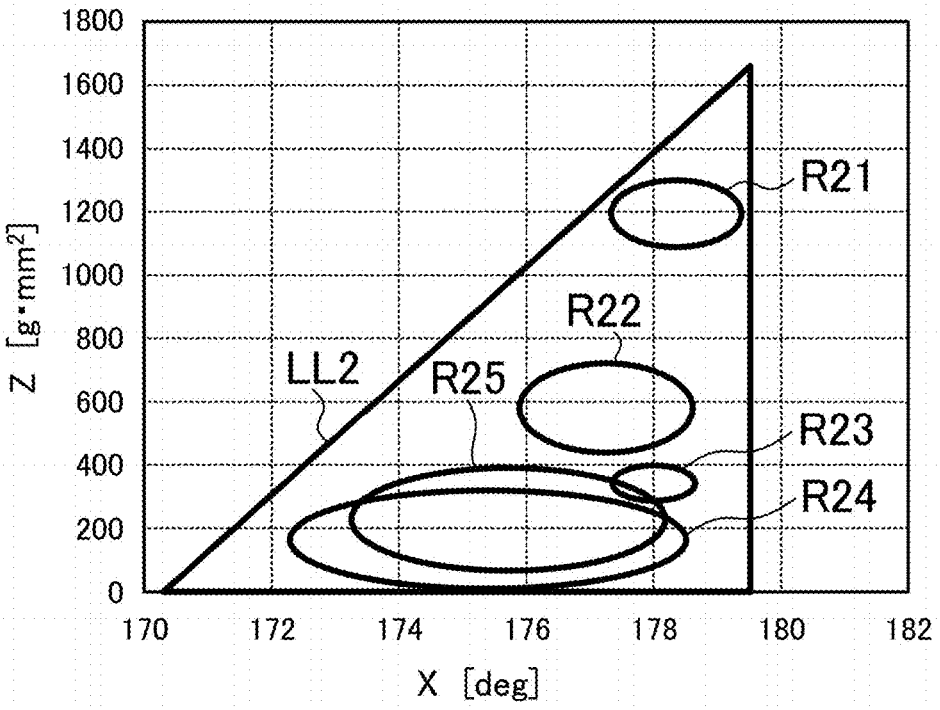
FIG. 16 is a graph illustrating, as an example, a second boundary related to a relationship between the angle difference (X) between the first weight and the second weight and the dynamic balance amount (Z) of the compressor when the index value related to the composite vibration at the connection portion of the compressor with the product is zero or less.

The inventors of the present application also checked, for each of the plurality of compressors (10), a relationship between the "angle difference (X) between the first weight (51) and the second weight (52)" and the "dynamic balance amount (Z)" when the index value was zero or less. As shown in FIG. 16, a plurality of regions corresponding to the plurality of compressors (10) were depicted on a graph whose horizontal axis represents the "angle difference (X) between the first weight (51) and the second weight (52)" and vertical axis represents the "dynamic balance amount (Z)." In the example of FIG. 16, five regions (R21 to R25) corresponding to five typical compressors (first to fifth compressors) are shown. The region (R21) corresponds to the first compressor. The regions (R22 to R25) correspond to the second to fourth compressors.

The inventors of the present application determined a second boundary (LL2) which defines an inclusion region including the plurality of regions in the graph of FIG. 16. In the example of FIG. 16, the second boundary (LL2) is formed by three straight lines which define a triangular region including the five regions (R21 to R25).

Figure 17:
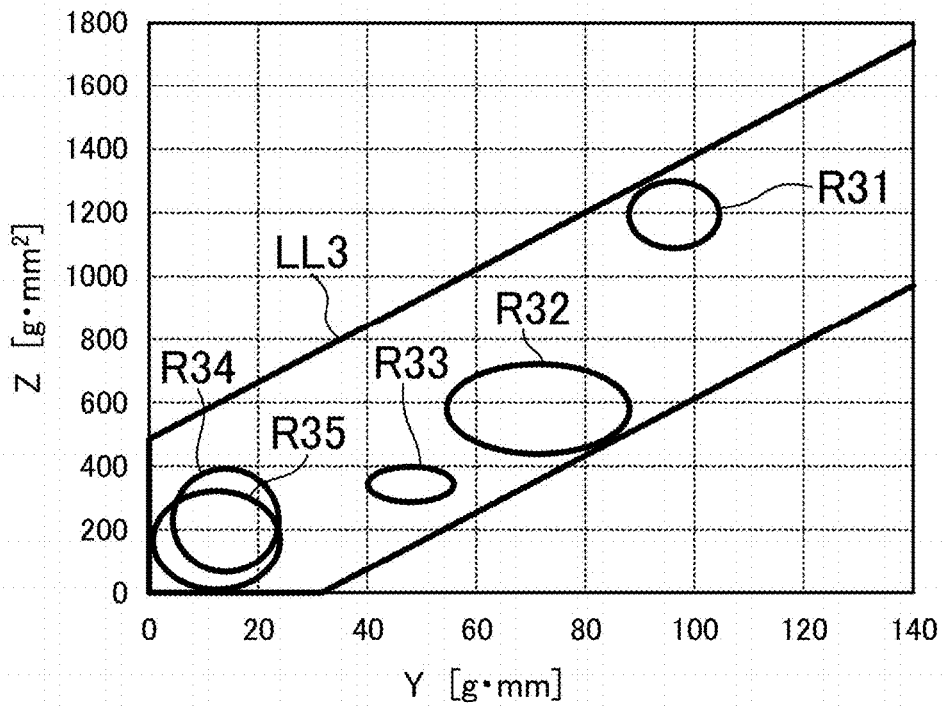
FIG. 17 is a graph showing, as an example, a third boundary related to a relationship between the static balance amount (Y) of the compressor and the dynamic balance amount (Z) of the compressor when the index value related to the composite vibration at the connection portion of the compressor with the product is zero or less.

The inventors of the present application also checked, for each of the plurality of compressors (10), a relationship between the "static balance amount (Y)" and the "dynamic balance amount (Z)" when the index value was zero or less. As shown in FIG. 17, a plurality of regions corresponding to the plurality of compressors (10) were depicted on a graph whose horizontal axis represents the "static balance amount (Y)" and vertical axis represents the "dynamic balance amount (Z)." In the example of FIG. 17, five regions (R31 to R35) corresponding to five typical compressors (first to fifth compressors) are shown. The region (R31) corresponds to the first compressor. The regions (R32 to R35) correspond to the second to fourth compressors.

The inventors of the present application determined a third boundary (LL3) which defines an inclusion region including the plurality of regions in the graph of FIG. 17. In the example of FIG. 17, the third boundary (LL3) is formed by five straight lines which define a pentagonal region including the five regions (R31 to R35).

Next, the inventors of the present application have found Expressions 11 to 17 below based on the first boundary (LL1) determined on the graph of FIG. 15, the second boundary (LL2) determined on the graph of FIG. 16, and the third boundary (LL3) determined on the graph of FIG. 17.

Mathematical Expression 17

$$Y \leq 18.8X - 3215 \cdots (11)$$

$$Z \leq 179X - 30480 \cdots (12)$$

$$Z \leq 9Y + 480 \cdots (13)$$

$$Z \geq 9Y - 290 \cdots (14)$$

$$X \leq 179.5 \cdots (15)$$

$$Y \geq 0 \cdots (16)$$

$$Z \geq 0 \cdots (17)$$

Specifically, Expressions 11 to 17 are derived by solving a first relational expression expressed by the first boundary (LL1), a second relational expression expressed by the second boundary (LL2), and a third relational expression expressed by the third boundary (LL3). The first relational expression is a relational expression between the angle difference (X) between the first weight (51) and the second weight (52) and the static balance amount (Y). The second relational expression is a relational expression between the angle difference (X) between the first weight (51) and the second weight (52) and the dynamic balance amount (Z). The third relational expression is a relational expression between the static balance amount (Y) and the dynamic balance amount (Z).

Effects of First Embodiment

As described above, in the first embodiment, the balancer (50) is configured such that at the connection portion of the compressor (10) with the product, the composite vibration ($a_t$) is the first vibration ($a_1$) or less: the composite vibration ($a_t$) is the synthesis of the first vibration ($a_1$) due to the torque according to the pressure difference between the low-pressure chamber (S1) and the high-pressure chamber (S2), the second vibration ($a_2$) due to the inertial force acting on the piston (35) by the eccentric rotational movement, and the third vibration ($a_3$) due to the centrifugal force acting on the rotary system (60).

In the above-described configuration, the balancer (50) is adjusted, thereby making it possible to adjust the composite vibration ($a_t$) at the connection portion of the compressor (10) with the product. Further, the composite vibration ($a_t$) at the connection portion of the compressor (10) with the product is set to be the first vibration ($a_1$) or less, thereby making it possible to reduce the vibration at the connection portion of the compressor (10) with the product.

Since the vibration (particularly, the vibration when the number of rotations of the compressor (10) is in the high-speed range) at the connection portion of the compressor (10) with the product can be reduced as described above, noise due to the vibration of the compressor (10) can be reduced. Since the size of the compressor (10) can also be reduced, the cost of the compressor (10) can be reduced.

In the first embodiment, the balancer (50) is configured to satisfy the above Expression 1 at the connection portion of the compressor (10) with the product when the operation condition of the compressor (10) is the "cooling operation condition where a pressure difference between the refrigerant sucked through the suction pipe (15) and the refrigerant discharged through the discharge pipe (16) is 2.0 MPa."

According to the above-described configuration, the composite vibration ($a_t$) at the connection portion of the compressor (10) with the product can be reduced to the first vibration ($a_1$) or less when the operation condition of the compressor (10) is the above-described cooling operation condition. It is therefore possible to reduce the vibration at the connection portion of the compressor (10) with the product.

In the first embodiment, the connection portion, i.e., a target for vibration reduction, of the compressor (10) with the product is the discharge pipe (16), and the balancer (50) is configured to satisfy the above Expressions 11 to 17 at the discharge pipe (16) when the operation condition of the compressor (10) is the above-described cooling operation condition.

According to the above-described configuration, the balancer (50) is adjusted based on Expressions 11 to 17 above. The balancer (50) can thus be easily configured to satisfy Expression 1 at the discharge pipe (16) when the operation condition of the compressor (10) is the above-described cooling operation condition. It is thus possible to reduce the composite vibration ($a_t$) at the discharge pipe (16) to the first vibration ($a_1$) or less when the operation condition of the compressor (10) is the above-described cooling operation condition, and therefore possible to reduce the vibration at the discharge pipe (16).

In the first embodiment, the range of the number of rotations at which the compressor (10) is operable includes a range of 90 rps or more.

According to the above-described configuration, the composite vibration ($a_t$) at the connection portion of the compressor (10) with the product can be reduced to the first vibration ($a_1$) or less, even when the number of rotations of the compressor (10) is in a range of 90 rps or more. It is thus possible to reduce the vibration at the connection portion of the compressor (10) with the product even when the number of rotations of the compressor (10) is in a range of 90 rps or more.

The accumulator (18) and the connection pipe (19) may be omitted from the compressor (10) of the first embodiment. In this case, the suction pipe (15) is attached to a lower portion of the barrel (12) of the casing (11), and penetrates the barrel (12). One end portion of the suction pipe (15) is connected to the compression mechanism (30).

Second Embodiment

A compressor (10) of a second embodiment is different from the compressor (10) of the first embodiment in a connection portion, i.e., a target for vibration reduction, of the compressor (10) with a product, and the configuration of a balancer (50). Other configurations of the compressor (10) of the second embodiment are similar to those of the compressor (10) of the first embodiment.

In the second embodiment, the connection portion, i.e., a target for vibration reduction, of the compressor (10) with the product is the suction pipe (15) connected to the compression mechanism (30) via the accumulator (18) and the connection pipe (19). The balancer (50) is configured to satisfy Expressions 21 to 27 below at the suction pipe (15) when the operation condition of the compressor (10) is the "cooling operation condition where a pressure difference between the refrigerant sucked through the suction pipe (15) and the refrigerant discharged through the discharge pipe (16) is 2.0 MPa."

Mathematical Expression 18

$$Y \geq 10X - 1880 \tag{21}$$

$$Z \geq 150X - 28200 \tag{22}$$

$$Z \geq 9Y + 1500 \tag{23}$$

$$Z \geq 9Y - 1000 \tag{24}$$

$$180.5 \leq X \leq 198 \tag{25}$$

$$0 \leq Y \leq 270 \tag{26}$$

$$0 \leq Z \leq 2400 \tag{27}$$

Results of Study by Inventors of the Present Application

As a result of study, the inventors of the present application have found the relational expressions (Expressions 21 to 27 above) which allow the balancer (50) to be easily configured to satisfy the above Expression 1 at the suction pipe (15) when the connection portion, i.e., a target for vibration reduction, of the compressor (10) with the product is the "suction pipe (15)" and the operation condition of the compressor (10) is the "cooling operation condition where a pressure difference between the refrigerant sucked through the suction pipe (15) and the refrigerant discharged through the discharge pipe (16) is 2.0 MPa."

The procedure in which the above-described relational expressions (Expressions 21 to 27) were found is similar to the procedure of "Results of Further Study by Inventors of The Present Application" in the first embodiment. Specifically, the inventors of the present application performed a simulation in a target compressor (10) to obtain "amplitude and phase of the first vibration ($a_1$)," "amplitude and phase of the second vibration ($a_2$)," and "amplitude and phase of the third vibration ($a_3$)" under the above-described conditions (i.e., when the connection portion, i.e., a target for vibration reduction, of the compressor (10) with the product is the suction pipe (15), and the operation condition of the compressor (10) is the above-described cooling operation condition). The subsequent procedure is similar to the procedure of "Results of Further Study by Inventors of The Present Application" in the first embodiment.

Effects of Second Embodiment

As described above, in the second embodiment, the connection portion, i.e., a target for vibration reduction, of the compressor (10) with the product is the suction pipe (15), and the balancer (50) is configured to satisfy the above Expressions 21 to 27 at the suction pipe (15) when the operation condition of the compressor (10) is the "cooling operation condition where a pressure difference between the refrigerant sucked through the suction pipe (15) and the refrigerant discharged through the discharge pipe (16) is 2.0 MPa."

According to the above-described configuration, the balancer (50) is adjusted based on Expressions 21 to 27 above. The balancer (50) can thus be easily configured to satisfy Expression 1 at the suction pipe (15) when the operation condition of the compressor (10) is the above-described cooling operation condition. It is thus possible to reduce the composite vibration ($a_t$) at the suction pipe (15) to the first vibration ($a_1$) or less when the operation condition of the compressor (10) is the above-described cooling operation condition, and therefore possible to reduce the vibration at the suction pipe (15).

Third Embodiment

The compressor (10) of the third embodiment is different from the compressor (10) of the first embodiment in the configuration of the balancer (50). Other configurations of the compressor (10) of the third embodiment are similar to those of the compressor (10) of the first embodiment.

In the third embodiment, the balancer (50) is configured to satisfy the following Expression 2 at the connection portion of the compressor (10) with the product when the operation condition of the compressor (10) is a "cooling operation condition where a pressure difference between the refrigerant sucked through the suction pipe (15) and the refrigerant discharged through the discharge pipe (16) is 2.0 MPa."

Mathematical Expression 19

$$A_2^2 + A_3^2 + 2A_1A_2\cos(\phi_1 - \phi_2) + 2A_2A_3\cos(\phi_2 - \phi_3) + 2A_3A_1\cos(\phi_3 - \phi_1) \le -0.75\,A_1^2 \quad (2)$$

Specifically, in the third embodiment, the connection portion, i.e., a target for vibration reduction, of the compressor (10) with the product is the discharge pipe (16). The balancer (50) is configured to satisfy Expressions 31 to 37 below at the discharge pipe (16) when the operation condition of the compressor (10) is the above-described cooling operation condition.

Mathematical Expression 20

$$Y \le 21X - 3630 \quad (31)$$

$$Z \le 290X - 50300 \quad (32)$$

$$Z \le 9Y + 420 \quad (33)$$

$$Z \ge 9Y - 200 \quad (34)$$

$$X \le 179 \quad (35)$$

$$Y \ge 0 \quad (36)$$

$$Z \ge 0 \quad (37)$$

Results of Study by Inventors of the Present Application

As a result of study, the inventors of the present application have found that the vibration (particularly, the vibration in the high-speed range) at the connection portion of the compressor (10) with the product can be further reduced by setting the magnitude of the composite vibration ($a_t$) at the connection portion of the compressor (10) with the product to the half of the magnitude of the first vibration ($a_1$) or less.

Here, a relational expression enabling a reduction in the vibration (particularly, the vibration in the high-speed range) at the connection portion of the compressor (10) with the product is expressed by Expression 7 below, where the magnitude of the composite vibration ($a_t$) is "$|a_t|$" and the magnitude of the first vibration ($a_1$) is "$|a_1|$."

Mathematical Expression 21

$$|a_t| \le 0.5\,|a_1| \quad (7)$$

Expression 7 above can be expanded as Expression 8 below.

Mathematical Expression 22

$$|a_t|^2 \le 0.25\,|a_1|^2 \quad (8)$$

$$\left|A_1e^{i\phi_1} + A_2e^{i\phi_2} + A_3e^{i\phi_3}\right|^2 \le 0.25\,A_1^2$$

$$A_1^2 + A_2^2 + A_3^2 + 2A_1A_2\cos(\phi_1 - \phi_2) + 2A_2A_3\cos(\phi_2 - \phi_3) + 2A_3A_1\cos(\phi_3 - \phi_1) \le -0.25\,A_1^2$$

Expression 8 above is expanded, and Expression 2 is obtained.

Mathematical Expression 23

$$A_2^2 + A_3^2 + 2A_1A_2\cos(\phi_1 - \phi_2) + 2A_2A_3\cos(\phi_2 - \phi_3) + 2A_3A_1\cos(\phi_3 - \phi_1) \le -0.75\,A_1^2 \quad (2)$$

The vibration at the connection portion of the compressor (10) with the product varies depending on the operation condition of the compressor (10). Thus, the inventors of the present application set the operation condition for evaluation of the vibration at the connection portion of the compressor (10) with the product to be the "cooling operation condition where a pressure difference between the refrigerant sucked through the suction pipe (15) and the refrigerant discharged through the discharge pipe (16) is 2.0 MPa." This cooling operation condition can be taken as a typical cooling operation condition.

As described above, the inventors of the present application have found that the balancer (50) configured to satisfy the above Expression 2 when the operation condition of the compressor (10) is the "cooling operation condition where a pressure difference between the refrigerant sucked through the suction pipe (15) and the refrigerant discharged through the discharge pipe (16) is 2.0 MPa" made it possible to further reduce the vibration at the connection portion of the compressor (10) with the product when the operation condition of the compressor (10) is the above cooling operation condition (typical cooling operation condition).

Results of Further Study by Inventors of the Present Application

As a result of further study, the inventors of the present application have found the relational expressions (Expressions 31 to 37 above) which allow the balancer (50) to be easily configured to satisfy the above Expression 2 at the discharge pipe (16) when the connection portion, i.e., a target for vibration reduction, of the compressor (10) with the product is the "discharge pipe (16)" and the operation condition of the compressor (10) is the "cooling operation condition where a pressure difference between the refrigerant sucked through the suction pipe (15) and the refrigerant discharged through the discharge pipe (16) is 2.0 MPa."

The procedure in which the above-described relational expressions (Expressions 31 to 37) were found is similar to the procedure of "Results of Further Study by Inventors of The Present Application" in the first embodiment. Specifically, the inventors of the present application performed a simulation in a target compressor (10) to obtain "amplitude and phase of the first vibration ($a_1$)," "amplitude and phase of the second vibration ($a_2$)," and "amplitude and phase of the third vibration ($a_3$)" under the above-described conditions (i.e., when the connection portion, i.e., a target for vibration reduction, of the compressor (10) with the product is the discharge pipe (16), and the operation condition of the compressor (10) is the above-described cooling operation condition). The subsequent procedure is similar to the procedure of "Results of Further Study by Inventors of The Present Application" in the first embodiment, except that "zero or less" is replaced with "–0.75 $A_1^2$ or less."

Effects of Third Embodiment

As described above, in the third embodiment, the balancer (50) is configured to satisfy the above Expression 2 at the connection portion of the compressor (10) with the product when the operation condition of the compressor (10) is the "cooling operation condition where a pressure difference between the refrigerant sucked through the suction pipe (15) and the refrigerant discharged through the discharge pipe (16) is 2.0 MPa."

According to the above-described configuration, the composite vibration ($a_t$) at the connection portion of the compressor (10) with the product can be reduced to 0.5 times the first vibration ($a_1$) or less when the operation condition of the compressor (10) is the above-described cooling operation condition. It is therefore possible to reduce the vibration at the connection portion of the compressor (10) with the product.

In the third embodiment, the connection portion, i.e., a target for vibration reduction, of the compressor (10) with the product is the discharge pipe (16), and the balancer (50) is configured to satisfy the above Expressions 31 to 37 at the discharge pipe (16) when the operation condition of the compressor (10) is the above-described cooling operation condition.

According to the above-described configuration, the balancer (50) is adjusted based on Expressions 31 to 37 above. The balancer (50) can thus be easily configured to satisfy Expression 2 at the discharge pipe (16) when the operation condition of the compressor (10) is the above-described cooling operation condition. It is thus possible to reduce the composite vibration ($a_t$) at the discharge pipe (16) to 0.5 times the first vibration ($a_1$) or less when the operation condition of the compressor (10) is the above-described cooling operation condition, and therefore possible to reduce the vibration at the discharge pipe (16).

The accumulator (18) and the connection pipe (19) may be omitted from the compressor (10) of the third embodiment. In this case, the suction pipe (15) is attached to a lower portion of the barrel (12) of the casing (11), and penetrates the barrel (12). One end portion of the suction pipe (15) is connected to the compression mechanism (30).

Fourth Embodiment

A compressor (10) of a fourth embodiment is different from the compressor (10) of the third embodiment in a connection portion, i.e., a target for vibration reduction, of the compressor (10) with a product, and the configuration of a balancer (50). Other configurations of the compressor (10) of the fourth embodiment are similar to those of the compressor (10) of the third embodiment.

In the fourth embodiment, the connection portion, i.e., a target for vibration reduction, of the compressor (10) with the product is the suction pipe (15) connected to the compression mechanism (30) via the accumulator (18) and the connection pipe (19). The balancer (50) is configured to satisfy Expressions 41 to 47 below at the suction pipe (15) when the operation condition of the compressor (10) is the "cooling operation condition where a pressure difference between the refrigerant sucked through the suction pipe (15) and the refrigerant discharged through the discharge pipe (16) is 2.0 MPa."

Mathematical Expression 24

$$Y \geq 10X - 1850 \quad (41)$$

$$Z \geq 315X - 59700 \quad (42)$$

$$Z \leq 9Y + 1100 \quad (43)$$

$$Z \geq 9Y - 600 \quad (44)$$

$$182 \leq X \leq 195 \quad (45)$$

$$0 \leq Y \leq 230 \quad (46)$$

$$0 \leq Z \leq 2000 \quad (47)$$

Results of Study by Inventors of the Present Application

As a result of study, the inventors of the present application have found the relational expressions (Expressions 41 to 47 above) which allow the balancer (50) to be easily configured to satisfy the above Expression 2 at the suction pipe (15) when the connection portion, i.e., a target for vibration reduction, of the compressor (10) with the product is the "suction pipe (15)" and the operation condition of the compressor (10) is the "cooling operation condition where a pressure difference between the refrigerant sucked through the suction pipe (15) and the refrigerant discharged through the discharge pipe (16) is 2.0 MPa."

The procedure in which the above-described relational expressions (Expressions 41 to 47) were found is similar to the procedure of "Results of Further Study by Inventors of The Present Application" in the third embodiment. Specifically, the inventors of the present application performed a simulation in a target compressor (10) to obtain "amplitude and phase of the first vibration ($a_1$)," "amplitude and phase of the second vibration ($a_2$)," and "amplitude and phase of the third vibration ($a_3$)" under the above-described conditions (i.e., when the connection portion, i.e., a target for vibration reduction, of the compressor (10) with the product is the suction pipe (15), and the operation condition of the compressor (10) is the above-described cooling operation condition). The subsequent procedure is similar to the procedure of "Results of Further Study by Inventors of The Present Application" in the third embodiment.

Effects of Fourth Embodiment

As described above, in the fourth embodiment, the connection portion, i.e., a target for vibration reduction, of the compressor (10) with the product is the suction pipe (15), and the balancer (50) is configured to satisfy the above Expressions 41 to 47 at the suction pipe (15) when the operation condition of the compressor (10) is the "cooling operation condition where a pressure difference between the refrigerant sucked through the suction pipe (15) and the refrigerant discharged through the discharge pipe (16) is 2.0 MPa."

According to the above-described configuration, the balancer (50) is adjusted based on Expressions 41 to 47 above. The balancer (50) can thus be easily configured to satisfy Expression 2 at the suction pipe (15) when the operation condition of the compressor (10) is the above-described cooling operation condition. It is thus possible to reduce the composite vibration ($a_t$) at the suction pipe (15) to 0.5 times the first vibration ($a_1$) or less when the operation condition of the compressor (10) is the above-described cooling operation condition, and therefore possible to reduce the vibration at the suction pipe (15).

Other Embodiments

In the description above, a case in which the refrigeration apparatus (RR) is the air conditioner capable of switching between a cooling operation and a heating operation has been described as an example, but the present disclosure is not limited thereto. For example, the refrigeration apparatus (RR) may be an apparatus dedicated to cooling or dedicated to heating. In this case, the four-way switching valve (RR8) may be omitted from the refrigeration apparatus (RR). The refrigeration apparatus (RR) may be a water heater, a chiller unit, or a cooling apparatus that cools the air in an internal space. The cooling apparatus cools the air in a refrigerator, a freezer, or a container, for example.

In the description above, a case in which the casing (11) is disposed such that the cylinder axis of the casing (11) is in the up-down direction has been described as an example, but the present disclosure is not limited thereto. For example, the casing (11) may be disposed such that the cylinder axis of the casing (11) is in the horizontal direction.

Figure 18:
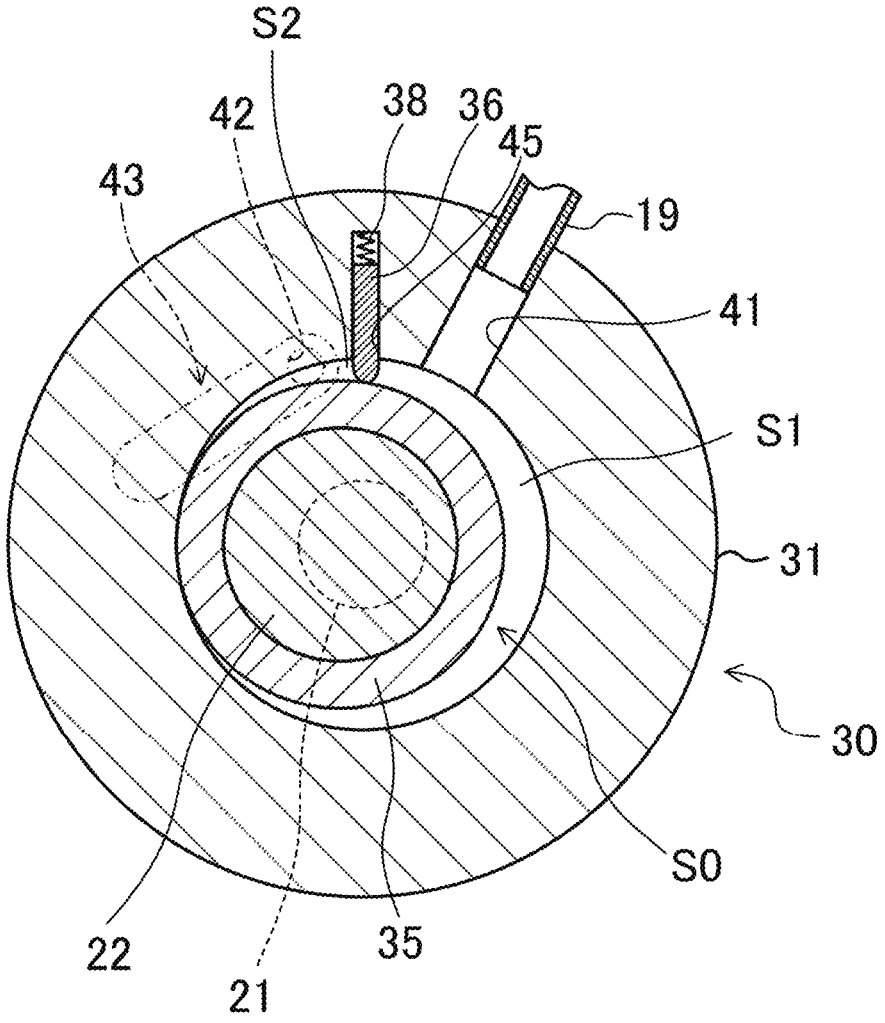
FIG. 18 is a horizontal cross-section illustrating, as an example, a configuration of a compression mechanism of another embodiment.

In the description above, a case in which the blade (36) is formed integrally with the piston (35) has been described as an example, but the present disclosure is not limited thereto. For example, as illustrated in FIG. 18, the blade (36) may be formed separately from the piston (35). In the example of FIG. 18, the cylinder (31) has a blade hole (45) instead of the bush hole (40). The blade hole (45) penetrates the cylinder (31) in the axial direction. The blade (36) is fitted in the blade hole (45) so as to move back and forth in the radial direction of the cylinder (31). The compression mechanism (30) has a spring (38) instead of the pair of bushes (37). The spring (38) is housed in the blade hole (45), and presses the blade (36) toward the piston (35). With such a configuration, an end portion of the blade (36) is in sliding contact with the outer peripheral surface of the piston (35).

In the description above, the discharge pipe (16) and the suction pipe (15) are given as examples of the connection portion, i.e., a target for vibration reduction, of the compressor (10) with the product, but the present disclosure is not limited thereto. For example, the connection portion, i.e., a target for vibration reduction, of the compressor (10) with the product may be the leg (17) of the casing (11) or may be other portions.

In the description above, the "cooling operation condition where a pressure difference between the refrigerant sucked through the suction pipe (15) and the refrigerant discharged through the discharge pipe (16) is 2.0 MPa" has been described as an example of the operation condition for reducing the vibration at the connection portion of the compressor (10) with the product, but the present disclosure is not limited thereto. The above-described operation condition of the compressor (10) may be an operation condition other than the cooling operation condition.

While the embodiments and variations thereof have been described above, it will be understood that various changes in form and details may be made without departing from the spirit and scope of the claims. The elements according to the embodiments, the variations thereof, and the other embodiments may be combined and replaced with each other.

As described above, the present disclosure is useful as a compressor and a refrigeration apparatus.

The invention claimed is:

1. A compressor configured to be mounted on a product, the compressor comprising:

a drive shaft having an eccentric shaft portion eccentric with respect to a rotation axis;

an electric motor having a rotor fixed to the drive shaft and configured to rotationally drive the drive shaft;

a compression mechanism having a piston configured to engage with the eccentric shaft portion and make an eccentric rotational movement, a cylinder configured to house the piston and form a fluid chamber, and a blade configured to divide the fluid chamber into a low-pressure chamber and a high-pressure chamber;

a balancer forming a rotary system together with the drive shaft and the rotor;

a casing configured to house the drive shaft, the electric motor, the compression mechanism, and the balancer;

a suction pipe provided to suck a fluid into the compression mechanism; and a discharge pipe provided to discharge a fluid compressed by the compression mechanism, the balancer being configured such that at a connection portion of the compressor with the product, a composite vibration being a first vibration or less, the composite vibration being a synthesis of the first vibration due to torque according to a pressure difference between the low-pressure chamber and the high-pressure chamber, a second vibration due to an inertial force acting on the piston by the eccentric rotational movement, and a third vibration due to a centrifugal force acting on the rotary system.

2. The compressor of claim 1, wherein the connection portion of the compressor with the product is any one of the discharge pipe, the suction pipe, and a leg of the casing.

3. The compressor of claim 2, wherein the product is a refrigeration apparatus configured to perform a cooling operation, and the fluid is a refrigerant, and the balancer is configured to satisfy the following Mathematical Expression 1 at the connection portion of the compressor with the product when an operation condition of the compressor is a cooling operation condition in which a pressure difference between a refrigerant sucked through the suction pipe and a refrigerant discharged through the discharge pipe is 2.0 MPa, where an amplitude of the first vibration is $A_1$, a phase of the first vibration is Φ1, an amplitude of the second vibration is $A_2$, a phase of the second vibration is Ø2, an amplitude of the third vibration is $A_3$, and
a phase of the third vibration is Φ3:

Mathematical Expression 1

$$A_2^2 + A_3^2 + 2A_1A_2\cos(\phi_1 - \phi_2) + 2A_2A_3\cos(\phi_2 - \phi_3) + 2A_3A_1\cos(\phi_3 - \phi_1) \le 0. \quad (1)$$

4. The compressor of claim 2, wherein
the product is a refrigeration apparatus configured to perform a cooling operation, and the fluid is a refrigerant, and
the balancer is configured to satisfy the following Expression 2 of Mathematical Expression 4 at the connection portion of the compressor with the product when an operation condition of the compressor is a cooling operation condition in which a pressure difference between a refrigerant sucked through the suction pipe and a refrigerant discharged through the discharge pipe is 2.0 MPa, where
an amplitude of the first vibration is $A_1$,
a phase of the first vibration is $\Phi_1$,
an amplitude of the second vibration is $A_2$,
a phase of the second vibration is $\Phi_2$,
an amplitude of the third vibration is $A_3$, and
a phase of the third vibration is $\Phi_3$:

Mathematical Expression 4

$$A_2^2 + A_3^2 + 2A_1A_2\cos(\phi_1 - \phi_2) + 2A_2A_3\cos(\phi_2 - \phi_3) + 2A_3A_1\cos(\phi_3 - \phi_1) \le -0.75A_1^2. \quad (2)$$

5. The compressor of claim 2, wherein
a range of the number of rotations at which the compressor is operable includes a range of 90 rps or more.
6. The compressor of claim 1, wherein
the product is a refrigeration apparatus configured to perform a cooling operation, and the fluid is a refrigerant, and
the balancer is configured to satisfy the following Mathematical Expression 1 at the connection portion of the compressor with the product when an operation condition of the compressor is a cooling operation condition in which a pressure difference between a refrigerant sucked through the suction pipe and a refrigerant discharged through the discharge pipe is 2.0 MPa, where
an amplitude of the first vibration is $A_1$,
a phase of the first vibration is $\Phi_1$,
an amplitude of the second vibration is $A_2$,
a phase of the second vibration is $\Phi_2$,
an amplitude of the third vibration is $A_3$, and
a phase of the third vibration is $\Phi_3$:

Mathematical Expression 1

$$A_2^2 + A_3^2 + 2A_1A_2\cos(\phi_1 - \phi_2) + 2A_2A_3\cos(\phi_2 - \phi_3) + 2A_3A_1\cos(\phi_3 - \phi_1) \le 0. \quad (1)$$

7. The compressor of claim 6, wherein
the balancer has a first weight located on a side of the rotor spaced from the compression mechanism, and a second weight located on a side of the rotor closer to the compression mechanism than the first weight,
an angle difference (X) between the first weight and the second weight, a static balance amount (Y) of the compressor, and a dynamic balance amount (Z) of the compressor are expressed by Expressions A, B, and C of Mathematical Expression 2 below, where
a weight of the first weight is $m_1$ grams,
a distance between the first weight and the rotation axis is $r_1$ millimeters,
an angle of the first weight about the rotation axis with respect to an eccentric direction of the eccentric shaft portion is $\theta_1$ degrees,
a weight of the second weight is $m_2$ grams,
a distance between the second weight and the rotation axis is $r_2$ millimeters,
an angle of the second weight about the rotation axis with respect to the eccentric direction of the eccentric shaft portion is $\theta_2$ degrees,
an eccentricity of the eccentric shaft portion is e millimeters,
a weight of the eccentric shaft portion is $m_e$ grams,
a weight of the piston is $m_P$ grams, and
a distance between the compression mechanism and a center of gravity of the rotary system is h millimeters,
the connection portion of the compressor with the product is the discharge pipe, and
the balancer is configured to satisfy Expressions 11 to 17 of Mathematical Expression 2 below at the discharge pipe when the operation condition of the compressor is the cooling operation condition:

Mathematical Expression 2

$$X = \theta_2 - \theta_1 \quad (A)$$

$$Y = m_1r_1\cos\theta_1 + m_2r_2\cos\theta_2 + (m_e + m_p)e \quad (B)$$

$$Z = Y \cdot h \quad (C)$$

$$Y \le 18.8X - 3215 \quad (11)$$

$$Z \le 179X - 30480 \quad (12)$$

$$Z \le 9Y + 480 \quad (13)$$

$$Z \ge 9Y - 290 \quad (14)$$

$$X \le 179.5 \quad (15)$$

$$Y \ge 0 \quad (16)$$

$$Z \ge 0. \quad (17)$$

8. The compressor of claim 7, wherein
a range of the number of rotations at which the compressor is operable includes a range of 90 rps or more.
9. The compressor of claim 3, further comprising:
an accumulator; and
a connection pipe configured to connect the accumulator and the compression mechanism,
the suction pipe being connected to the compression mechanism via the accumulator and the connection pipe,
the balancer having a first weight located on a side of the rotor spaced from the compression mechanism, and a second weight located on a side of the rotor closer to the compression mechanism than the first weight, an angle difference (X) between the first weight and the second weight, a static balance amount (Y) of the compressor, and a dynamic balance amount (Z) of the compressor are expressed by Expressions A, B, and C of Mathematical Expression 3 below, where a weight of the first weight is $m_1$ grams, a distance between the first weight and the rotation axis is $r_1$ millimeters, an angle of the first weight about the rotation axis with respect to an eccentric direction of the eccentric shaft portion is $\theta_1$ degrees, a weight of the second weight is $m_2$ grams, a distance between the second weight and the rotation axis is $r_2$ millimeters, an angle of the second weight about the rotation axis with respect to the eccentric direction of the eccentric shaft portion is $\theta_2$ degrees, an eccentricity of the eccentric shaft portion is e millimeters, a weight of the eccentric shaft portion is $m_e$ grams, a weight of the piston is $m_P$ grams, and a distance between the compression mechanism and a center of gravity of the rotary system is h millimeters, the connection portion of the compressor with the product being the suction pipe, and the balancer being configured to satisfy Expressions 21 to 27 of Mathematical Expression 3 below at the suction pipe when the operation condition of the compressor is the cooling operation condition:

Mathematical Expression 3

$$X = \theta_2 - \theta_1 \quad \text{(A)}$$

$$Y = m_1 r_1 \cos\theta_1 + m_2 r_2 \cos\theta_2 + (m_e + m_p)\, e \quad \text{(B)}$$

$$Z = Y \cdot h \quad \text{(C)}$$

$$Y \geq 10\,X - 1880 \quad (21)$$

$$Z \geq 150\,X - 28200 \quad (22)$$

$$Z \geq 9\,Y + 1500 \quad (23)$$

$$Z \geq 9\,Y - 1000 \quad (24)$$

$$180.5 \leq X \leq 198 \quad (25)$$

$$0 \leq Y \leq 270 \quad (26)$$

$$0 \leq Z \leq 2400. \quad (27)$$

10. The compressor of claim 9, wherein a range of the number of rotations at which the compressor is operable includes a range of 90 rps or more.

11. The compressor of claim 6, wherein a range of the number of rotations at which the compressor is operable includes a range of 90 rps or more.

12. The compressor of claim 1, wherein the product is a refrigeration apparatus configured to perform a cooling operation, and the fluid is a refrigerant, and the balancer is configured to satisfy the following Expression 2 of Mathematical Expression 4 at the connection portion of the compressor with the product when an operation condition of the compressor is a cooling operation condition in which a pressure difference between a refrigerant sucked through the suction pipe and a refrigerant discharged through the discharge pipe is 2.0 MPa, where an amplitude of the first vibration is $A_1$, a phase of the first vibration is $\Phi_1$, an amplitude of the second vibration is $A_2$, a phase of the second vibration is $\Phi_2$, an amplitude of the third vibration is $A_3$, and a phase of the third vibration ($a_3$) is $\Phi_3$:

Mathematical Expression 4

$$A_2^2 + A_3^2 + 2A_1A_2\cos(\phi_1 - \phi_2) + 2A_2A_3\cos(\phi_2 - \phi_3) + 2A_3A_1\cos(\phi_3 - \phi_1) \leq -0.75\,A_1^2. \quad (2)$$

13. The compressor of claim 12, wherein the balancer has a first weight located on a side of the rotor spaced from the compression mechanism, and a second weight located on a side of the rotor closer to the compression mechanism than the first weight, an angle difference (X) between the first weight and the second weight, a static balance amount (Y) of the compressor, and a dynamic balance amount (Z) of the compressor are expressed by Expressions A, B, and C of Mathematical Expression 5 below, where a weight of the first weight is $m_1$ grams, a distance between the first weight and the rotation axis is $r_1$ millimeters, an angle of the first weight about the rotation axis with respect to an eccentric direction of the eccentric shaft portion is $\theta_1$ degrees, a weight of the second weight is $m_2$ grams, a distance between the second weight and the rotation axis is $r_2$ millimeters, an angle of the second weight about the rotation axis with respect to the eccentric direction of the eccentric shaft portion is $\theta_2$ degrees, an eccentricity of the eccentric shaft portion is e millimeters, a weight of the eccentric shaft portion is $m_e$ grams, a weight of the piston is $m_P$ grams, and a distance between the compression mechanism and a center of gravity of the rotary system is h millimeters, the connection portion of the compressor with the product is the discharge pipe, and the balancer is configured to satisfy Expressions 31 to 37 of Mathematical Expression 5 below at the discharge pipe when the operation condition of the compressor is the cooling operation condition:

Mathematical Expression 5

$$X = \theta_2 - \theta_1 \quad \text{(A)}$$

$$Y = m_1 r_1 \cos\theta_1 + m_2 r_2 \cos\theta_2 + (m_e + m_p)\, e \quad \text{(B)}$$

$$Z = Y \cdot h \quad \text{(C)}$$

$$Y \leq 21\,X - 3630 \quad (31)$$

$$Z \leq 290\,X - 50300 \quad (32)$$

$$Z \leq 9\,Y + 420 \quad (33)$$

$$Z \geq 9\,Y - 200 \quad (34)$$

-continued $$X \leq 179 \quad (35)$$

$$Y \geq 0 \quad (36)$$

$$Z \geq 0. \quad (37)$$

14. The compressor of claim 13, wherein a range of the number of rotations at which the compressor is operable includes a range of 90 rps or more.

15. The compressor of claim 12, further comprising:

an accumulator; and a connection pipe configured to connect the accumulator and the compression mechanism, the suction pipe being connected to the compression mechanism via the accumulator and the connection pipe, the balancer having a first weight located on a side of the rotor spaced from the compression mechanism, and a second weight located on a side of the rotor closer to the compression mechanism than the first weight, an angle difference (X) between the first weight and the second weight, a static balance amount (Y) of the compressor, and a dynamic balance amount (Z) of the compressor are expressed by Expressions A, B, and C of Mathematical Expression 6 below, where a weight of the first weight is $m_1$ grams, a distance between the first weight and the rotation axis is $r_1$ millimeters, an angle of the first weight about the rotation axis with respect to an eccentric direction of the eccentric shaft portion is $\theta_1$ degrees, a weight of the second weight is $m_2$ grams, a distance between the second weight and the rotation axis is $r_2$ millimeters, an angle of the second weight about the rotation axis with respect to the eccentric direction of the eccentric shaft portion is $\theta_2$ degrees, an eccentricity of the eccentric shaft portion is e millimeters, a weight of the eccentric shaft portion is $m_e$ grams, a weight of the piston is $m_P$ grams, and a distance between the compression mechanism and a center of gravity of the rotary system is h millimeters, the connection portion of the compressor with the product is the suction pipe, and the balancer is configured to satisfy Expressions 41 to 47 of Mathematical Expression 6 below at the suction pipe when the operation condition of the compressor is the cooling operation condition:

Mathematical Expression 6

$$X = \theta_2 - \theta_1 \quad (A)$$

$$Y = m_1 r_1 \cos\theta_1 + m_2 r_2 \cos\theta_2 + (m_e + m_p)\, e \quad (B)$$

$$Z = Y \cdot h \quad (C)$$

$$Y \geq 10\,X - 1850 \quad (41)$$

$$Z \geq 315\,X - 59700 \quad (42)$$

$$Z \leq 9\,Y + 1100 \quad (43)$$

$$Z \geq 9\,Y - 600 \quad (44)$$

$$182 \leq X \leq 195 \quad (45)$$

$$0 \leq Y \leq 230 \quad (46)$$

$$0 \leq Z \leq 2000. \quad (47)$$

16. The compressor of claim 15, wherein a range of the number of rotations at which the compressor is operable includes a range of 90 rps or more.

17. The compressor of claim 12, wherein a range of the number of rotations at which the compressor is operable includes a range of 90 rps or more.

18. The compressor of claim 1, wherein a range of the number of rotations at which the compressor is operable includes a range of 90 rps or more.

19. A refrigeration apparatus including the compressor of claim 1.

* * * * *